US011708641B2

(12) United States Patent
Palmore et al.

(10) Patent No.: US 11,708,641 B2
(45) Date of Patent: Jul. 25, 2023

(54) COPPER CATALYSTS FOR ELECTROCHEMICAL $CO_2$ REDUCTION TO $C_{2+}$ PRODUCTS

(71) Applicant: Brown University, Providence, RI (US)

(72) Inventors: G. Tayhas R. Palmore, Providence, RI (US); Taehee Kim, Providence, RI (US)

(73) Assignee: Brown University, Providence, RI (US)

( * ) Notice: Subject to any disclaimer, the term of this patent is extended or adjusted under 35 U.S.C. 154(b) by 0 days.

(21) Appl. No.: 17/393,151

(22) Filed: Aug. 3, 2021

(65) Prior Publication Data

US 2022/0042198 A1 Feb. 10, 2022

Related U.S. Application Data

(60) Provisional application No. 63/060,213, filed on Aug. 3, 2020.

(51) Int. Cl.

| | |
|---|---|
| ***C25B 11/061*** | (2021.01) |
| ***C25B 3/26*** | (2021.01) |
| ***C25F 3/26*** | (2006.01) |
| ***C25D 11/34*** | (2006.01) |
| ***C25D 21/12*** | (2006.01) |
| ***C25F 7/00*** | (2006.01) |

(52) U.S. Cl.

CPC ..... *C25F 7/00* (2013.01); *C25B 3/26* (2021.01); *C25B 11/061* (2021.01); *C25D 11/34* (2013.01); *C25D 21/12* (2013.01); *C25F 3/26* (2013.01)

(58) Field of Classification Search

CPC ..... C25B 3/26; C25D 11/34

See application file for complete search history.

(56) References Cited

PUBLICATIONS

Kwon et al "CO2 electroreduction with enhanced ethylene and ethanol selectivity via nanostructuring of polycrystalline copper" ChemElectroChem, 2016, vol. 3, Issue 6, p. 1012-1019. (Year: 2016).*

Chen et al "Stable and selective electrochemical reduction of carbon dioxide to ethylene on copper mesocrystals" Catal. Sci. Technol., 2015, 5, 161-168 (Year: 2015).*

Han et al "A reconstructed porous copper surface promotes selective and efficiency toward C2 products by electrocatalytic CO2 reduction" Chem. Sci., 2020, 11, 10698-10704 (Year: 2020).*

Wang et al "Rapid and Scalable Synthesis of Cuprous Halide-Derived Copper Nano-Architectures for Selective Electrochemical Reduction of Carbon Dioxide" Nano Letters, 2019, 19, 3925-3932 (Year: 2019).*

Roberts, F. S.; Kuhl, K. P; Nilsson, A "High Selectivity for Ethylene from Carbon Dioxide Reduction over Copper Nanocube Electrocatalysts" Angew. Chem. Int. Ed. 2015, 54, 5179-5182. (Year: 2015).*

(Continued)

*Primary Examiner* — Brian W Cohen

(74) *Attorney, Agent, or Firm* — Adler Pollock & Sheehan P.C.

(57) ABSTRACT

An electrochemical method includes performing anodic halogenation of Cu foils, performing subsequent oxide-formation in a $KHCO_3$ electrolyte, and performing an electroreduction in neutral $KHCO_3$ to generate a copper catalyst.

8 Claims, 22 Drawing Sheets

(56) References Cited

PUBLICATIONS

Xiao , et al., "Mechanistic Explanation of the pH Dependence and Onset Potentials for Hydrocarbon Products from Electrochemical Reduction of CO on Cu (111)", Journal of the American Chemical Society, vol. 138, 2016, pp. 483-486.
Xu , et al., "Global Warming will happen Faster than We Think", Nature, vol. 564, Dec. 6, 2018, pp. 30-32.
Xu , et al., "Shape Evolution and Size-Controllable Synthesis of Cu2O Octahedra and Their Morphology-Dependent Photocatalytic Properties", The Journal of Physical Chemistry B, vol. 110, No. 28, 2006, pp. 13829-13834.
Zhang , et al., "Cu Nanowire-Catalyzed Electrochemical Reduction of CO or CO2", Nanoscale, vol. 11, 2019, pp. 12075-12079.
Ahrland , et al., "The Relative Affinities of Ligand Atoms for Acceptor Molecules and Ions", Quarterly Reviews, Chemical Society, vol. 12, 1958, pp. 265-276.
Ahrland , et al., "Thermodynamics of Metal Complex Formation in Aqueous Solution. XIII. Enthalpy Measurements on Copper (I) and Silver (I) Halide Systems", Acta Chemica Scandinavica A, vol. 31, 1977, pp. 625-634.
Bianchi , et al., "Copper in Sea-Water, Potential-pH Diagrams", Corrosion Science, vol. 13, 1973, pp. 853-864.
Calle-Vallejo , et al., "Theoretical Considerations on the Electroreduction of CO to C2 Species on Cu(100) Electrodes", Angewandte Chemie International Edition, vol. 52, 2013, pp. 7282-7285.
Cavalca , et al., "Nature and Distribution of Stable Subsurface Oxygen in Copper Electrodes During Electrochemical CO2 Reduction", The Journal of Physical Chemistry C, vol. 121, 2017, pp. 25003-25009.
Chen , et al., "Electrochemical Reduction of Carbon Dioxide to Ethane Using Nanostructured Cu2O-Derived Copper Catalyst and Palladium(II) Chloride", The Journal of Physical Chemistry, vol. 119, 2015, pp. 26875-26882.
Cheng , et al., "Nature of the Active Sites for CO Reduction on Copper Nanoparticles; Suggestions for Optimizing Performance", Journal of the American Chemical Society, vol. 139, 2017, pp. 11642-11645.
Durand , et al., "Structure Effects on the Energetics of the Electrochemical Reduction of CO2 by Copper Surfaces", Surface Science, vol. 605, 2011, pp. 1354-1359.
Eilert , et al., "Subsurface Oxygen in Oxide-Derived Copper Electrocatalysts for Carbon Dioxide Reduction", Journal of Physical Chemistry Letters, vol. 8, 2016, pp. 285-290.
Favaroa , et al., "Subsurface Oxide Plays a Critical Role in CO2 Activation by Cu(111) Surfaces to Form Chemisorbed CO2, the First Step in Reduction of CO2", Proceedings of the National Academy of Sciences, vol. 114, No. 26, Jun. 27, 2017, pp. 6706-6711.
Fields , et al., "Role of Subsurface Oxygen on Cu Surfaces for CO2 Electrochemical Reduction", The Journal of Physical Chemistry C, vol. 122, 2018, pp. 16209-16215.
Gao , et al., "Plasma-Activated Copper Nanocube Catalysts for Efficient Carbon Dioxide Electroreduction to Hydrocarbons and Alcohols", ACS Nano, vol. 11, 2017, pp. 4825-4831.
Garza , et al., "Is Subsurface Oxygen Necessary for the Electrochemical Reduction of CO2 on Copper?", The Journal of Physical Chemistry Letters, vol. 9, 2018, pp. 601-606.
Gattrell , et al., "A Review of the Aqueous Electrochemical Reduction of Co2 to Hydrocarbons at Copper", Journal of Electroanalytical Chemistry, vol. 594, 2006, pp. 1-19.
Goodpaster , et al., "Identification of Possible Pathways for C—C Bond Formation during Electrochemical Reduction of CO2: New Theoretical Insights from an Improved Electrochemical Model", The Journal of Physical Chemistry Letters, vol. 7, 2016, pp. 1471-1477.
Gupta , et al., "Calculation for the Cathode Surface Concentrations in the Electrochemical Reduction of CO2 in KHCO3 Solutions", Journal of Applied Electrochemistry, vol. 36, 2006, pp. 161-172.
Hori , et al., "Electrocatalytic Process of CO Selectivity in Selectrochemical Reduction of CO2 at Metal Electrodes in Aqueous Media", Electrochimica Acta, vol. 39, No. 11/12, 1994, pp. 1833-1839.
Hori, Y. , "Electrochemical CO2 Reduction on Metal Electrodes", Modern Aspects of Electrochemistry, vol. 42, 2008, pp. 89-189.
Hori , et al., "Electrochemical Reduction of Carbon Dioxide at Various Series of Copper Single Crystal Electrodes", Journal of Molecular Catalysis A: Chemical, vol. 199, 2003, pp. 39-47.
Huang , et al., "Electrochemical Reduction of CO2 Using Copper Single-Crystal Surfaces: Effects of CO* Coverage on the Selective Formation of Ethylene", ACS Catalysis, vol. 7, 2017, pp. 1749-1756.
Kibria , et al., "A Surface Reconstruction Route to High Productivity and Selectivity in CO2 Electroreduction toward C2+ Hydrocarbons", Advanced Materials, vol. 30, 1804867, 2018, pp. 1-7.
Kibria , et al., "Electrochemical CO2 Reduction into Chemical Feedstocks: From Mechanistic Electrocatalysis Models to System Design", Advanced Materials, e1807166, 2019, pp. 1-24.
Kim , et al., "A Scalable Method for Preparing Cu Electrocatalysts that Convert CO2 into C2+ Products", Nature Communications, vol. 11, 2020, pp. 1-11.
Kim , et al., "Copper Nanoparticle Ensembles for Selective Electroreduction of CO2 to C2—C3 Products", Proceedings of the National Academy of Sciences, vol. 114, 2017, pp. 10560-10565.
King , et al., "An Update of the State-of-the-art Report on the Corrosion of Copper Under Expected Conditions in a Deep Geologic Repository", Posiva Oy, Jul. 2012, 252 pages.
Kortlever , et al., "Catalysts and Reaction Pathways for the Electrochemical Reduction of Carbon Dioxide", The Journal of Physical Chemistry Letters vol. 6, 2015, pp. 4073-4082.
Kuhl , et al., "New Insights into the Electrochemical Reduction of Carbon Dioxide on Metallic Sopper Surfaces", Energy & Environmental Science, vol. 5, 2012, pp. 7050-7059.
Li , et al., "CO2 Reduction at Low Overpotential on Cu Electrodes Resulting from the Reduction of Thick Cu2O Films", Journal of the American Chemical Society, vol. 134, 2012, pp. 7231-7234.
Li , et al., "Structure-Sensitive CO2 Electroreduction to Hydrocarbons on Ultrathin 5-fold Twinned Copper Nanowires", Nano Letters, vol. 17, 2017, pp. 1312-1317.
Liu , et al., "pH Effects on the Electrochemical Reduction of CO(2) Towards C2 Products on Stepped Copper", Nature Communications, vol. 10, No. 32, 2019, pp. 1-10.
Loiudice , et al., "Tailoring Copper Nanocrystals towards C2 Products in Electrochemical CO2 Reduction", Angewandte Chemie International Edition, vol. 55, 2016, pp. 5789-5792.
Lum , et al., "Stability of Residual Oxides in Oxide-Derived Copper Catalysts for Electrochemical CO2 Reduction Investigated with 18O Labeling", Angewandte Chemie International Edition, vol. 57, 2018, pp. 551-554.
Martens , et al., "The Extended X-Ray Absorption Fine Structure in the Reflectivity at the K Edge of Cu", Journal of Physics C: Solid State Physics, vol. 14, 1981, pp. 1523-1534.
McCrum , et al., "Electrochemical specific adsorption of halides on Cu 111,100, and 211: A Density Functional Theory study", Electrochimica Acta, vol. 173, 2015, pp. 302-309.
Mistry , et al., "Highly Selective Plasma-Activated Copper Catalysts for Carbon Dioxide Reduction to Ethylene", Nature Communications, vol. 7, No. 12123, 2016, pp. 1-8.
Nie , et al., "Selectivity of CO2 Reduction on Copper Electrodes: The Role of the Kinetics of Elementary Steps", Angewandte Chemie International Edition, vol. 52, 2013, pp. 2459-2462.
Nitopi , et al., "Progress and Perspectives of Electrochemical CO2 Reduction on Copper in Aqueous Electrolyte", Chemical Reviews, vol. 119, 2019, pp. 7610-7672.
Parrat, L. G, "Surface Studies of Solids by Total Reflection of X-Rays", Physical Review, vol. 95, No. 2, Jul. 15, 1954, pp. 359-369.
Perez-Gallent , et al., "Spectroscopic Observation of a Hydrogenated CO Dimer Intermediate During CO Reduction on Cu(100) Electrodes", Angewandte Chemie, vol. 129, 2017, pp. 3675-3678.
Peterson , et al., "How Copper Catalyzes the Electroreduction of Carbon Dioxide into Hydrocarbon Fuels", Energy & Environmental Science, vol. 3, 2010, pp. 1311-1315.

(56) References Cited

PUBLICATIONS

Pourbaix, Marcel , "Atlas of Electrochemical Equilibria in Aqueous Solutions", National Association of Corrosion Engineers, 1974, 648 pages.
Raciti , et al., "Local pH Effect in the CO2 Reduction Reaction on High-Surface-Area Copper Electrocatalysts", Journal of The Electrochemical Society, vol. 165, No. 10, 2018, pp. F799-F804.
Roberts , et al., "High Selectivity for Ethylene from Carbon Dioxide Reduction over Copper Nanocube Electrocatalysts", Angewandte Chemie International Edition, vol. 57, 2015, pp. 5179-5182.
Sandberg , et al., "CO—CO Coupling on Cu Facets: Coverage, Strain and Field Effects", Surface Science, vol. 654, 2016, pp. 56-62.
Sawyer, J. S, "Man-Made Carbon Dioxide and the "Greenhouse" Effect", Nature, vol. 239, Sep. 1, 1972, pp. 23-26.
Schwab , et al., "Cuprous Halides", Progress in Crystal Growth and Characterization, vol. 5, 1982, pp. 233-276.
Sen , et al., "Electrochemical Reduction of CO2 at Copper Nanofoams", ACS Catalysis, vol. 4, 2014, pp. 3091-3095.
Singh , et al., "Effects of Electrolyte, Catalyst, and Membrane Composition and Operating Conditions on the Performance of Solar-Driven Electrochemical Reduction of Carbon Dioxide", Physical Chemistry Chemical Physics, vol. 17, No. 29, Aug. 7, 2015, pp. 18924-18936.
Singh , et al., "Hydrolysis of Electrolyte Cations Enhances the Electrochemical Reduction of CO2 over Ag and Cu", Journal of the American Chemical Society, vol. 138, 2016, pp. 13006-13012.
Xiao , et al., "Cu Metal Embedded in Oxidized Matrix Catalyst to Promote CO2 Activation and CO Dimerization for Electrochemical Reduction of CO2", Proceedings of the National Academy of Sciences, vol. 114, No. 26, Jun. 27, 2017, pp. 6685-6688.

* cited by examiner

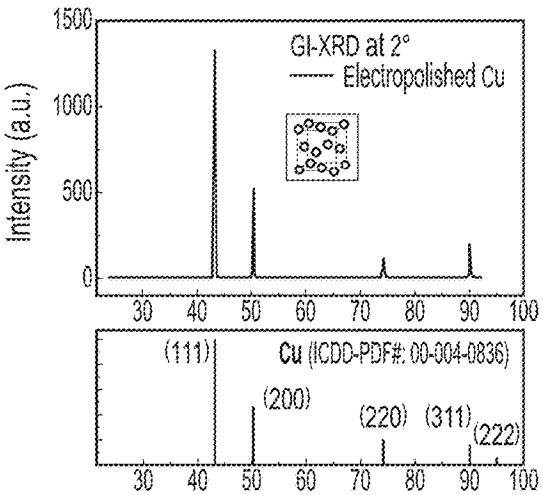
FIG. 3A
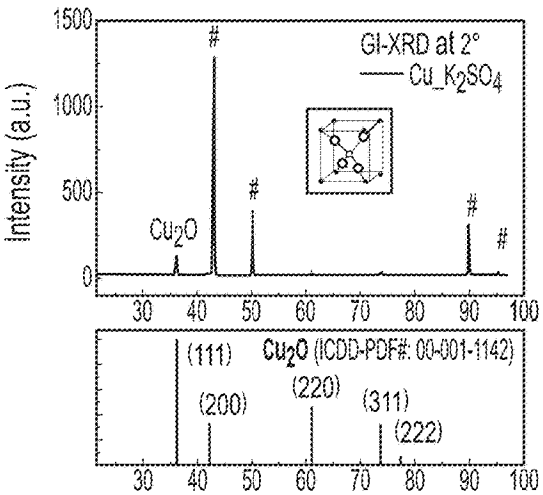
FIG. 3B
FIG. 3C
FIG. 3D
FIG. 3E

Halogenated Cu

Halogenated Cu immersed in 0.1 M $KHCO_3$ for 10 min

Halogenated Cu immersed in 0.1 M $KHCO_3$ and reduced by LSV

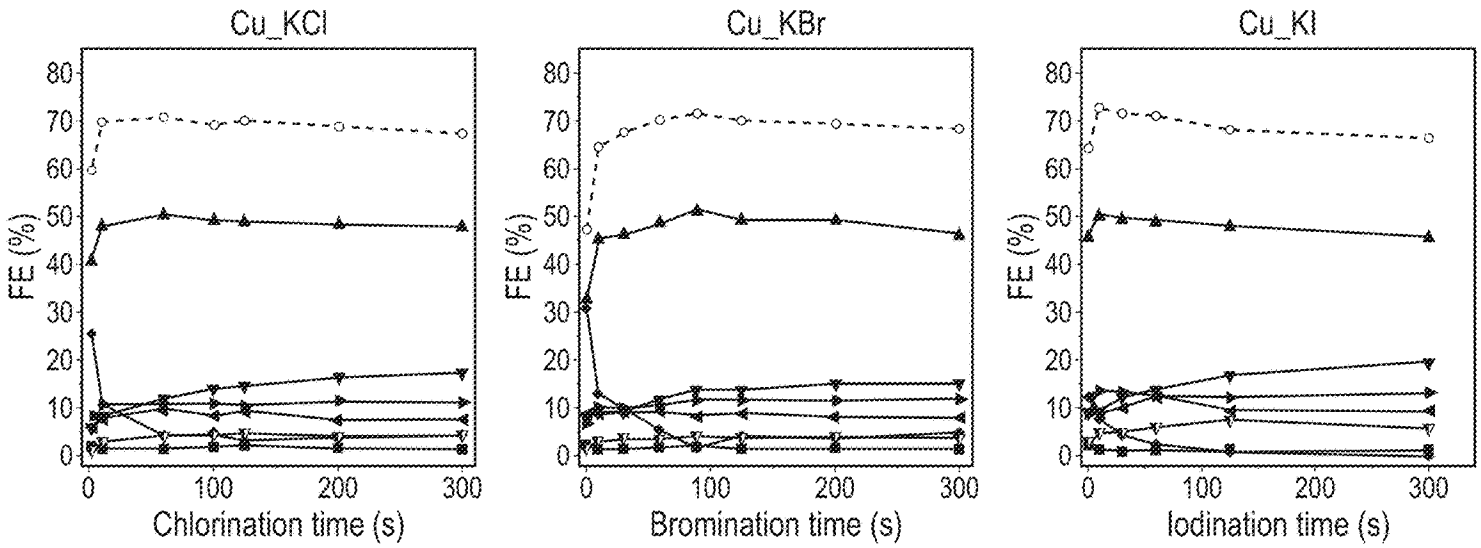
FIG. 16A
FIG. 16B
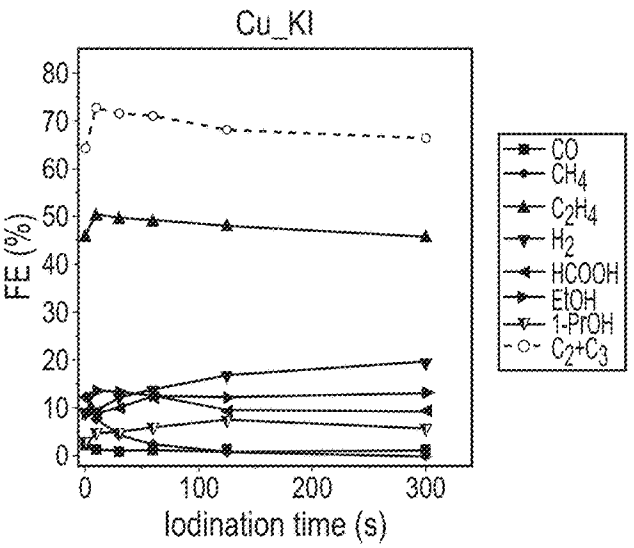
FIG. 16C
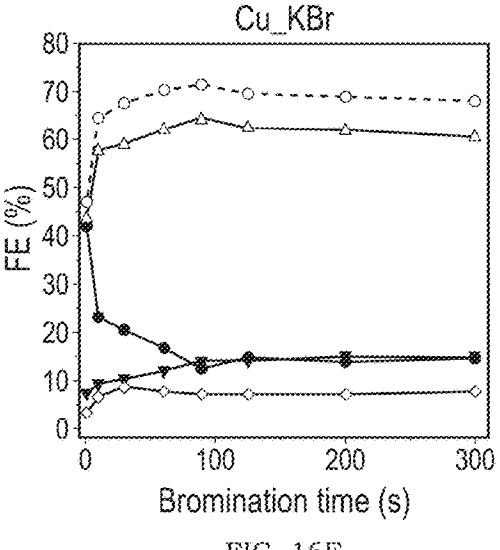
FIG. 16D
FIG. 16E
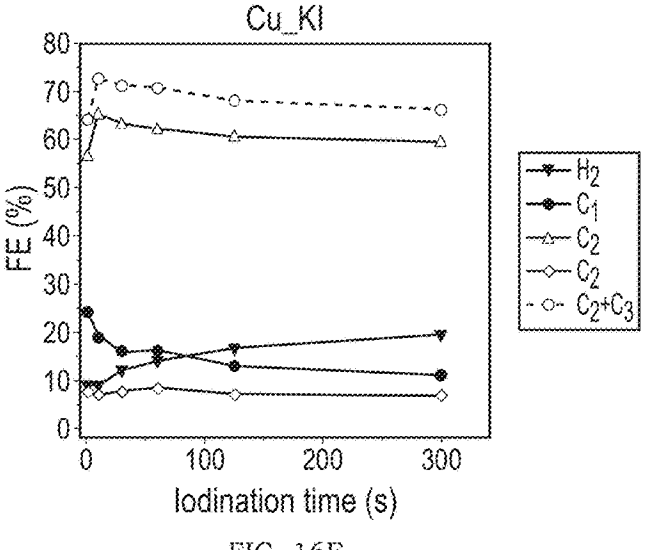
FIG. 16F

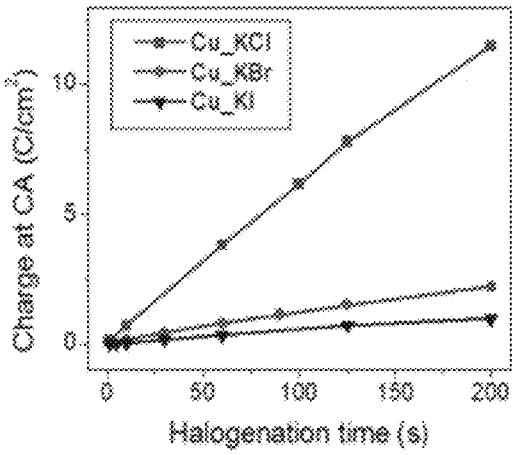
FIG. 17A
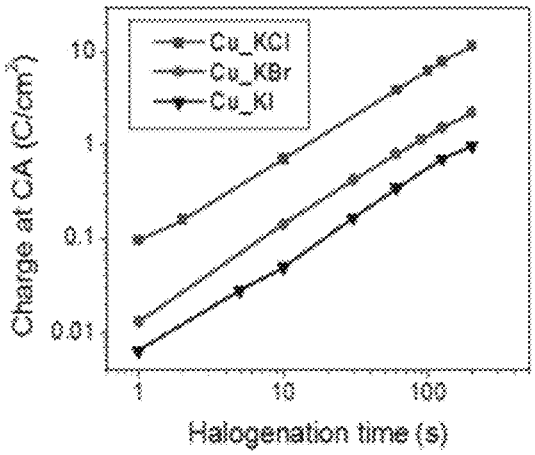
FIG. 17B
| | Catalyst | $V_{app}$ (Ag/AgCl) | $J$ (mA/cm²) | $V_{corr}$ (Ag/AgCl) | $V_{corr}$ (RHE) | FE (%) | | | | | | | | | | | | |
|---|---|---|---|---|---|---|---|---|---|---|---|---|---|---|---|---|---|---|
| | | | | | | CO | $CH_4$ | $C_2H_4$ | $H_2$ | HCOO | EtOH | PrOH | Other | Total | $C_1$ | $C_2$ | $C_3$ | $C_{2+}$ |
| Fig.4 | EP_Cu | -2.11 | 19.6 | -1.78 | -1.18 | 3.6 | 54 | 13.28 | 7.2 | 9.1 | 4.4 | 0.7 | 5.5 | 97.6 | 66.6 | 20.4 | 3.4 | 23.82 |
| | Cu_KCl 100 s | -2.11 | 45.5 | -1.73 | -1.14 | 1.7 | 5.8 | 45.14 | 14.6 | 11.2 | 11 | 3.7 | 5.7 | 98.9 | 18.7 | 57.7 | 7.9 | 65.60 |
| | Cu_KBr 60 s | -2.11 | 42.7 | -1.75 | -1.15 | 1.0 | 9.6 | 49.47 | 11.7 | 5.6 | 12.8 | 3.4 | 8.1 | 98.2 | 16.2 | 65.4 | 6.3 | 71.71 |
| | Cu_KI 1 s | -2.11 | 40.0 | -1.74 | -1.15 | 2.0 | 14 | 44.54 | 8.9 | 6.7 | 9.8 | 3.2 | 7.7 | 98.8 | 24.7 | 57.4 | 7.8 | 65.21 |
| Fig.5 | Cu_KCl 60 s | -2.11 | 40.3 | -1.71 | -1.11 | 1.6 | 4.1 | 50.15 | 12.0 | 9.7 | 10.9 | 4.3 | 5.3 | 98.1 | 15.4 | 62.9 | 7.9 | 70.73 |
| | Cu_KBr 90 s | -2.11 | 43.3 | -1.70 | -1.10 | 2.3 | 1.7 | 50.94 | 13.6 | 6.7 | 12 | 4.4 | 4.2 | 98.0 | 12.6 | 64.4 | 7.2 | 71.64 |
| | Cl_KI 30s | -2.11 | 40.0 | -1.66 | -1.09 | 1.5 | 8.4 | 49.99 | 9.3 | 9.2 | 13.8 | 5.2 | 3.6 | 98.0 | 19.1 | 65.3 | 7.2 | 72.53 |
FIG. 18
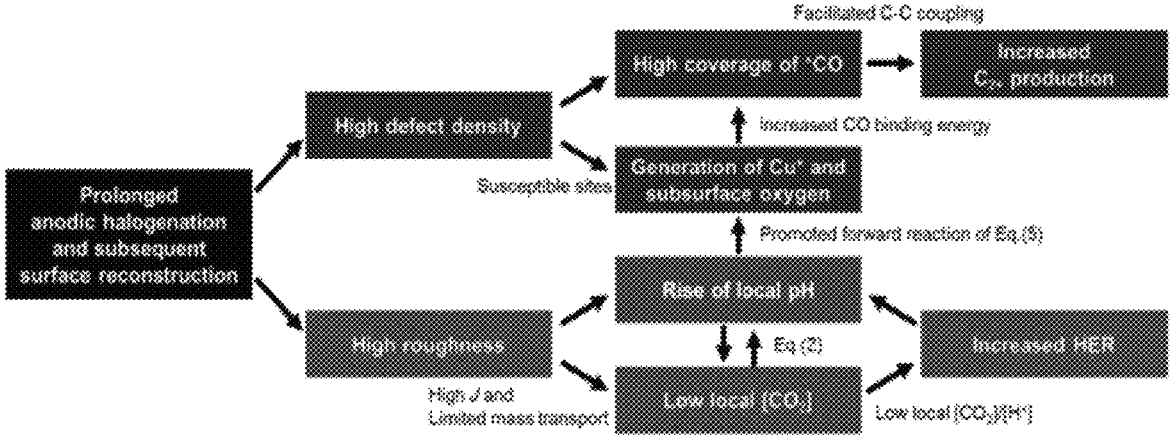
FIG. 19

Finished with Reduction

Finished with Oxidation

COPPER CATALYSTS FOR ELECTROCHEMICAL $CO_2$ REDUCTION TO $C_{2+}$ PRODUCTS

CROSS REFERENCE TO RELATED APPLICATIONS

This application claims benefit from U.S. Provisional Patent Application Ser. No. 63/060,213, filed Aug. 3, 2020, which is incorporated by reference in its entirety.

STATEMENT REGARDING GOVERNMENT INTEREST

This invention was made with government support under grant number CHE-1240020 awarded by the National Science Foundation. The government has certain rights in the invention.

BACKGROUND OF THE INVENTION

The present invention relates generally to catalysts for the selective electroreduction of carbon dioxide ($CO_2$) to high-value products, and specifically to copper catalysts for electrochemical $CO_2$ reduction to $C_{2+}$ products.

In general, the combustion of fossil fuels to carbon dioxide ($CO_2$) is the leading cause of global warming due to the accumulation of $CO_2$ in the atmosphere. The electrochemical $CO_2$ reduction reaction ($CO_2$ RR), driven by renewable energy, is a promising strategy to reduce $CO_2$ emissions. By converting $CO_2$ waste into products of higher value (i.e., ethylene, ethanol, 1-propanol, and so forth), a closed-loop carbon economy begins to emerge. To make $CO_2$ RR economically viable, more efficient electrocatalysts with high selectivity for targeted products at scale are needed.

SUMMARY OF THE INVENTION

The following presents a simplified summary of the innovation in order to provide a basic understanding of some aspects of the invention. This summary is not an extensive overview of the invention. It is intended to neither identify key or critical elements of the invention nor delineate the scope of the invention. Its sole purpose is to present some concepts of the invention in a simplified form as a prelude to the more detailed description that is presented later.

In general, in one aspect, the invention features an electrochemical method including performing anodic halogenation of Cu foils, performing subsequent oxide-formation in a $KHCO_3$ electrolyte, and performing an electroreduction in neutral $KHCO_3$ to generate a copper catalyst.

In another aspect, the invention features method of preparing electrocatalysts including mechanically polishing Cu foils, rinsing the polished Cu foils, electropolishing the Cu foils by chronoamperometry in 85% phosphoric acid at 1.5 V with a Cu counter electrode in a two-electrode configuration, rinsing the electropolished Cu foils, cutting the electropolished Cu foils into $2\times0.5$ $cm^2$ pieces, flattening the electropolished Cu foils, covering a back side and part of a front side of the flattened electropolished Cu foils with polyimide (PI) tape to define a geometric area of a working electrode, and wrapping the working electrode in PTFE tape to prevent detachment of the PI tape, exposing an area of 0.35 $cm^2$.

These and other features and advantages will be apparent from a reading of the following detailed description and a review of the associated drawings. It is to be understood that both the foregoing general description and the following detailed description are explanatory only and are not restrictive of aspects as claimed.

BRIEF DESCRIPTION OF THE DRAWINGS

These and other features, aspects, and advantages of the present invention will become better understood with reference to the following description, appended claims, and accompanying drawings where:

FIGS. 3A-3E illustrate crystal structures of halogenated Cu identified by GI-XRD.

FIG. 16A-16F illustrates an effect of halogenation time on the performance of the catalysts for $CO_2$ RR.

FIG. 17A-17B illustrates linear scale and log-scale plots.

FIG. 18 illustrates a table of representative FEs.

FIG. 19 illustrates a flow diagram.

DETAILED DESCRIPTION

Figure 1:
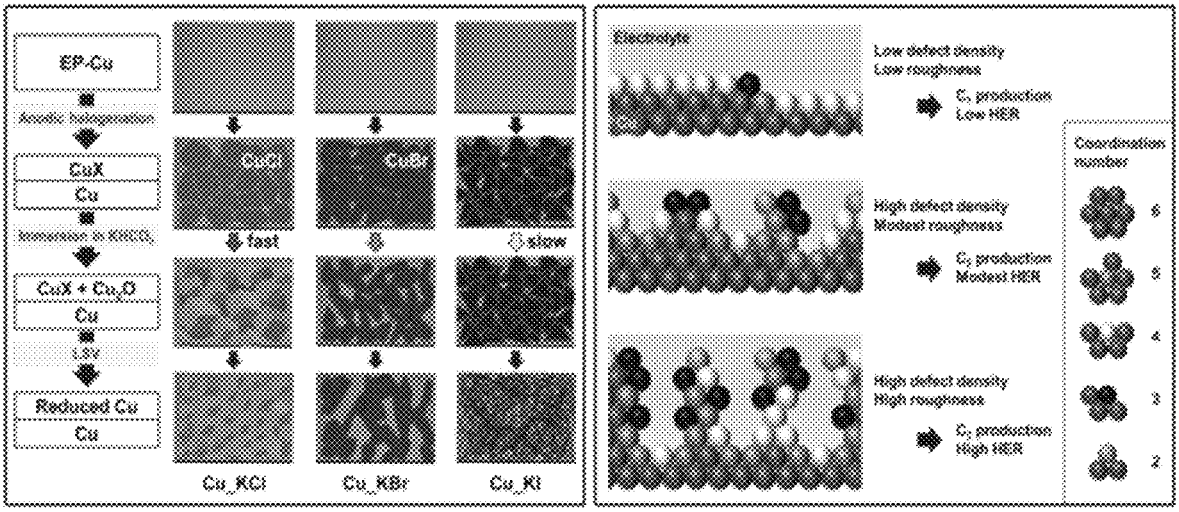
FIG. 1 illustrates an exemplary scheme.

The subject innovation is now described with reference to the drawings, wherein like reference numerals are used to refer to like elements throughout. In the following description, for purposes of explanation, numerous specific details are set forth in order to provide a thorough understanding of the present invention. It may be evident, however, that the present invention may be practiced without these specific details. In other instances, well-known structures and devices are shown in block diagram form in order to facilitate describing the present invention.

Development of efficient catalysts for the selective electroreduction of carbon dioxide ($CO_2$) to high-value products is essential for the deployment of carbon capture and utilization technologies. The present invention is a scalable method for preparing Cu electrocatalysts that favor $CO_2$ conversion to $C_{2+}$ products. This method involves anodic halogenation of Cu foils and their subsequent surface reconstruction by oxide-formation and electrochemical reduction. This method results in catalysts that convert $CO_2$ to ethylene with faradaic efficiencies (FE) up to 50.0% and with FE for total $C_{2+}$ products of 72% at −1.09 V vs. reversible hydrogen electrode (RHE). Results from scanning electron microscopy (SEM) and energy dispersive X-ray spectroscopy (EDS) studies show that significant changes to the morphology of Cu occur during anodic halogenation and subsequent oxide-formation and reduction, resulting in catalysts with a high density of defect sites but relatively low roughness. These defect sites facilitate C—C coupling reactions of adsorbed carbon intermediates, leading to the formation of $C_2$ products such as ethylene. Excessive anodic halogenation (i.e., longer reaction times) diminishes FE for $C_{2+}$ products by increasing the roughness of the Cu surface to the point of favoring the competing hydrogen evolution reaction (HER). The efficient conversion of $CO_2$ to $C_{2+}$ products requires a Cu catalyst with a high density of defect sites that promote adsorption of carbon intermediates and C—C coupling reactions while minimizing roughness, features that are intrinsic to the scalable electrochemical method described.

Despite improvements in recent years, advances are needed particularly in scalable methods for producing catalysts that efficiently convert $CO_2$ to high-value multi-carbon products. As such, the design of catalysts that selectively produce $C_{2+}$ products by electrochemical $CO_2$ RR should focus on minimizing two competing reaction pathways: (1) the hydrogen evolution reaction (HER) and (2) $C_1$ product formation (e.g., $CH_4$, HCOOH). Both pathways reduce the faradaic efficiency of $C_{2+}$ products by consuming electrons and protons. The second competing reaction, $C_1$ production, reduces the amount of adsorbed carbon intermediates available for surface C—C coupling reactions, an important step in the pathway to $C_2$ and $C_3$ products.

To minimize HER, the first step of electrochemical $CO_2$ RR must be enhanced. This first step involves a one electron, one proton reduction of $CO_2$ to form adsorbed COOH (*COOH) and is a reaction that is affected by the concentration ratio of dissolved $CO_2$ to protons ($[CO_2]/[H+]$) near the electrode surface. The relative concentration of dissolved $CO_2$ and protons near the electrode surface under conditions used for the electrochemical $CO_2$ RR is significantly different from bulk concentrations. Moreover, the high current densities observed at highly roughened electrocatalysts causes the pH to increase rapidly to as high as 11. Despite the low concentration of protons at this high pH, the efficiency of $CO_2$ RR is reduced due to limited mass transport of $CO_2$ on the highly rough surface. Therefore, to favor electrochemical $CO_2$ RR over HER, a catalyst with minimal roughness should be used to mitigate the rise of local pH. For the same purpose, the thickness of the interfacial diffusion layer near the catalyst surface also should be reduced.

To minimize $C_1$ product formation, catalysts should be designed to take advantage of new insights gained from simulations of the electrochemical $CO_2$ RR. These simulations have provided an energy landscape that relates the energetics of competing reaction pathways available on Cu. For example, the onset potential to form adsorbed CO (*CO) is predicted to be lowest on the (211) step site of Cu among the three crystal facets of Cu simulated: (111), (100), and (211). Adsorbed CO is an important intermediate in the pathway that leads to $C_2$ products by C—C coupling. Once *CO is formed on a Cu surface, the activation energy barrier to form the C—C coupling product, *OCCO, is thermodynamically lowest on Cu (100) relative to (111) and (211). In addition, the energy barrier for CO dimerization decreases with increased *CO coverage. From the perspective of kinetics, $C_2$ product formation follows second-order kinetics with a rate that is proportional to the concentration of reactive $C_1$ intermediates such as *CO. Here, the rate determining step is dimerization of CO to form $C_2$ products. Other $C_1$ intermediates possessing unsaturated bonds (*CHO, *COH, *CH2, and *CHOH), which are derived by reduction of *CO, react with *CO to yield $C_{2+}$ products. Thus, a high surface coverage of reactive $C_1$ intermediates are needed, which can be obtained by a high density of active sites (i.e., surface defects). Defect sites such as grain boundaries, step sites, and vacancies that result in under-coordinated atoms on the surface of a catalyst promote C—C coupling. In addition, $Cu^+$ and subsurface oxygen in Cu may promote the adsorption of $CO_2$ and the C—C coupling, although the stability of subsurface oxygen remains controversial.

To maximize the amount of Cu (100) surface, cubic structures of Cu formed when a Cu foil is cycled between oxidizing and reducing potentials in 0.1 M KCl. In all cases, the catalysts were shown to be more selective for ethylene than methane. However, the FE for $C_2H_4$ ranged between 15% and 45%. This difference is likely due to the chemical complexity of the electrochemical cycling method used. At least six different chemical reactions occur when cycling Cu foils between oxidizing and reducing potentials: (1) dissolution (i.e., corrosion) of $Cu^+$ or $Cu^{2+}$ cations into the electrolyte at an oxidizing potential, (2) formation of CuCl in the presence of KCl at an oxidizing potential, (3) conversion of CuCl into $Cu_2O$, (4) electrodeposition of dissolved $Cu^+$ or $Cu^2$ cations onto the Cu electrode at a reducing potential, and (5-6) reduction of $Cu_2O$ and CuCl to Cu at a reducing potential. Any one of these reactions can affect the performance of the catalyst.

Prior advances inspired us to study the parameters influencing catalyst performance separately (i.e., chemical species present and their reactivity/solubility, applied potential, pH, and roughness) in order to develop the present electrochemical method that utilizes these parameters to produce a Cu catalyst selective for $C_{2+}$ products. We show the resulting catalysts, with a balance of high density of defect sites (i.e., under-coordinated Cu) and low roughness, efficiently convert $CO_2$ to $C_2$ and $C_3$ products (FE $C_{2+}$ of 72%) by electrochemical $CO_2$ RR.

The present invention is an advance over previous methods because, as one example, it involves three steps that have the characteristics desirable for carbon utilization technologies: simple to perform, consistent, regenerative, and scalable. As shown in FIG. 1, these steps are (i) anodic halogenation of Cu foils, (ii) subsequent oxide-formation in a $KHCO_3$ electrolyte, and (iii) electroreduction. Here, chlorinated Cu, brominated Cu, or iodinated Cu were prepared by applying an oxidative potential to Cu foils immersed in 0.1 M KCl, KBr, or KI, respectively, and are henceforth denoted as Cu_KCl, Cu_Br, and Cu_KI to reflect the different electrolytes used for anodic halogenation. Analysis of the morphological and chemical changes by SEM and EDS elucidated the processes by which subsequent surface reconstruction occurs. EDS also provides evidence that subsurface oxygen at the defect sites of Cu_KCl, Cu_Br, and Cu_KI are produced during $CO_2$ RR via oxidation of Cu by high local pH of the electrolyte. The efficiency of these catalysts at converting $CO_2$ to $C_2$ and $C_3$ products by electrochemical $CO_2$ RR provides strong evidence that both a high density of defect sites and low roughness are critical to promoting the formation of $C_{2+}$ products through electrochemical $CO_2$ RR by minimizing competing HER and $C_1$ production.

Preparation of Electrocatalysts

Figure 2:
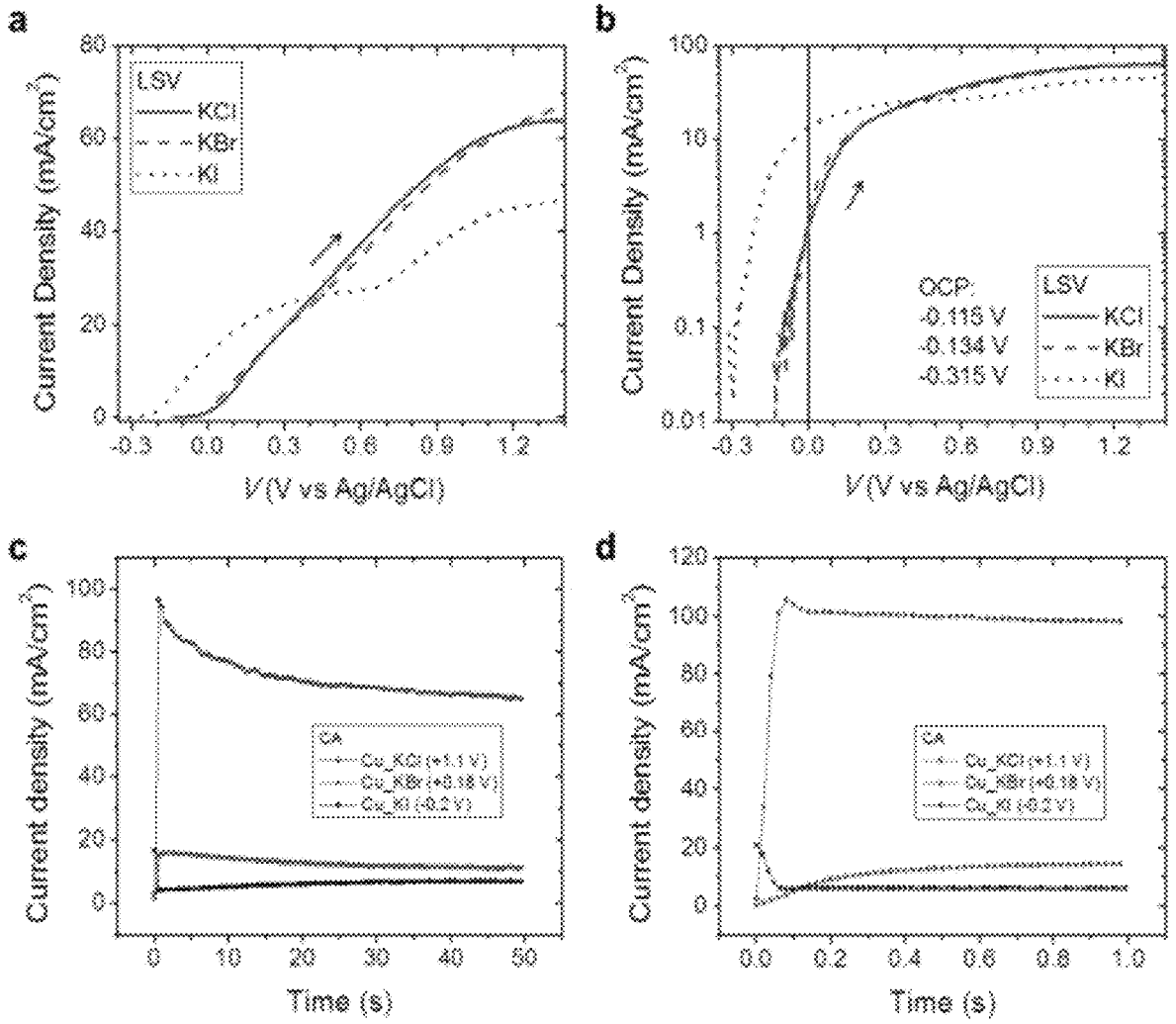
FIG. 2 illustrates an anodic halogenation of Cu foils.

Halogenated Cu foils were prepared by applying an oxidative potential to electropolished Cu foils immersed in an electrolyte containing halide ions. A three-electrode configuration was used: Cu foil working electrode, Pt gauze counter electrode, and Ag/AgCl reference electrode. The open circuit potential (OCP) of Cu foil immersed in 0.1 M KCl, KBr, or KI aqueous electrolyte was −0.115 V, −0.134 V, and −0.315 V vs. Ag/AgCl, respectively (see FIG. 2). Chronoamperometric potentials of 1.1 V, 0.18 V, and −0.2 V vs. Ag/AgCl were applied to a Cu foil working electrode while immersed in 0.1 M KCl, KBr, or KI, respectively. Note that the working electrode experiences an effective potential ($V_{eff}$) defined as: $V_{eff}=V_{app}-V_{oc}$, where $V_{app}$ is the applied potential and $V_{oc}$ is the measured OCP. For example, an applied potential of −0.2 V vs. Ag/AgCl in 0.1 M KI corresponds to an effective potential of 0.115 V vs. Ag/AgCl, which anodically iodinates the Cu. Current density vs. anodic halogenation time for each electrolyte is shown in FIG. 2.

Evaluation of Changes in the Crystal Structure of Cu_KX

As illustrated in FIGS. 3A-3E, the crystal structure of Cu foils subjected to anodic halogenation was identified by Grazing Incident X-ray Diffraction (GI-XRD). Included is GI-XRD data of control samples: the original electropolished Cu foil (FIG. 3A) and of electropolished Cu foil after being oxidized in the absence of halide ions (0.05 M $K_2SO_4$ aqueous electrolyte, 1.1 V vs. Ag/AgCl, 300 s) (FIG. 3B). The GI-XRD data of the control sample shows that oxidation in the absence of halide ions produces $Cu_2O$ on the surface of the Cu foil. In contrast, anodic halogenation of electropolished Cu foils in KCl, KBr, or KI results in the formation of CuCl, CuBr, or CuI, respectively (FIGS. 3C-3E).

Evaluation of Changes in the Morphology of Cu_KX

Figure 4A:
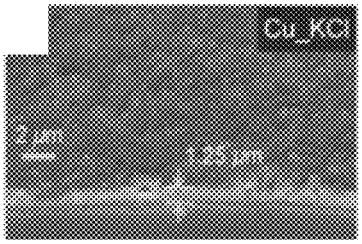
FIG. 4A-4L illustrate a morphology of halogenated Cu foil electrodes.
Figure 4B:
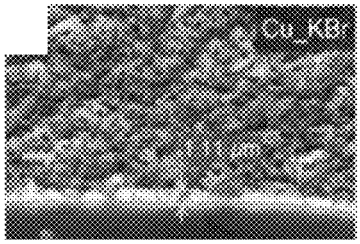
Figure 4C:
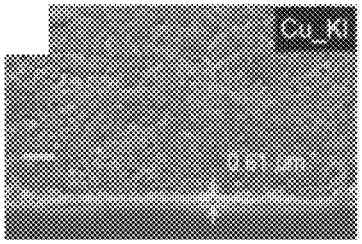
Figure 4D:
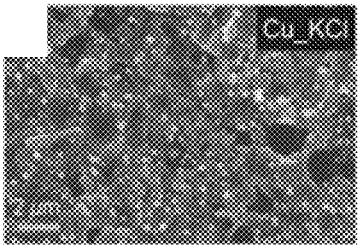
Figure 4E:
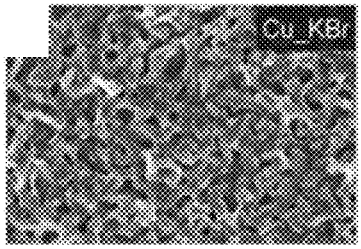
Figure 4F:
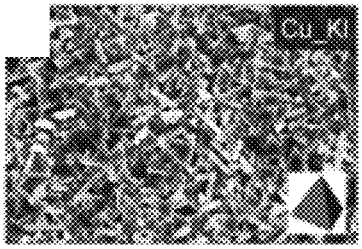
Figure 10:
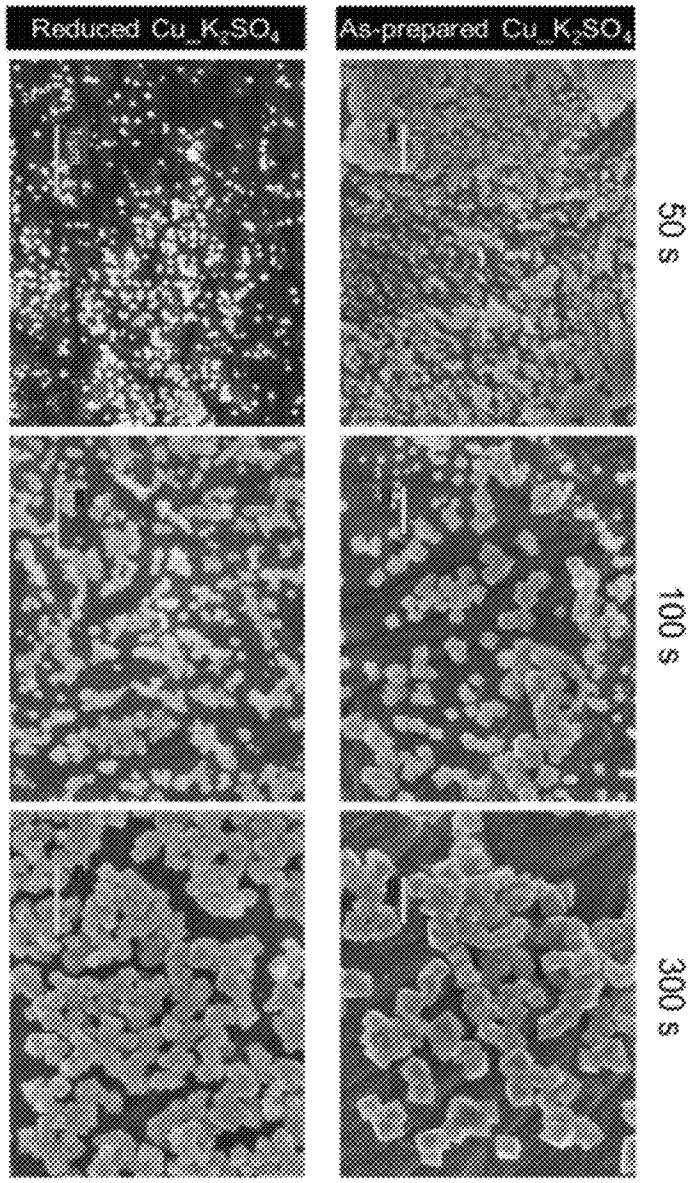
FIG. 10 illustrates plan-view SEM images.
Figure 11A:
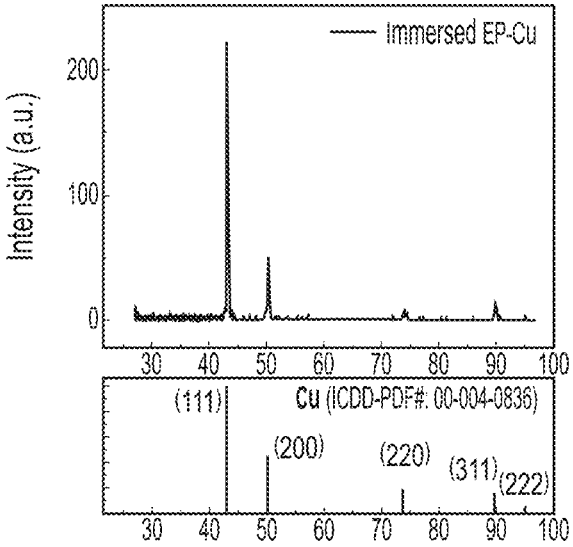
FIG. 11A-11D illustrate GI-XRD data.
Figure 11B:
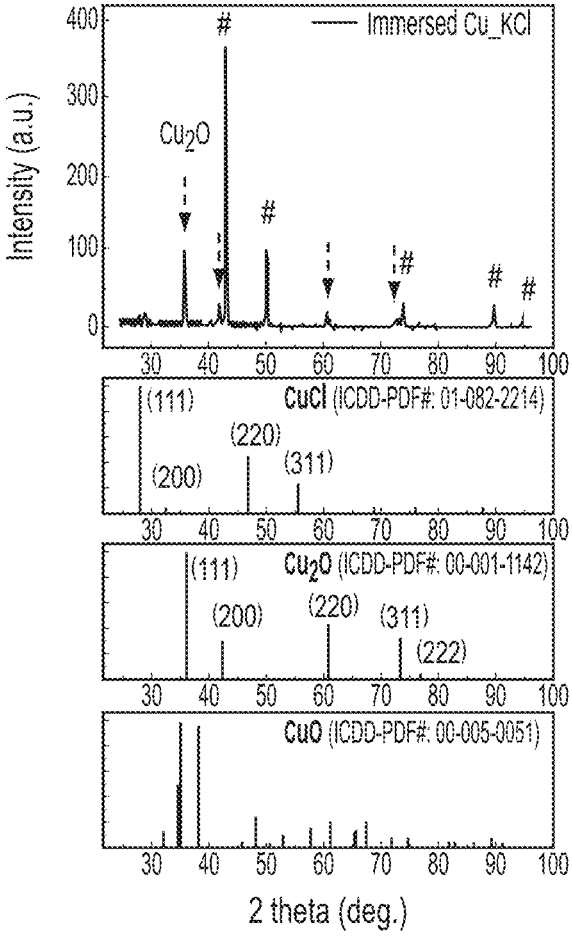
Figure 11C:
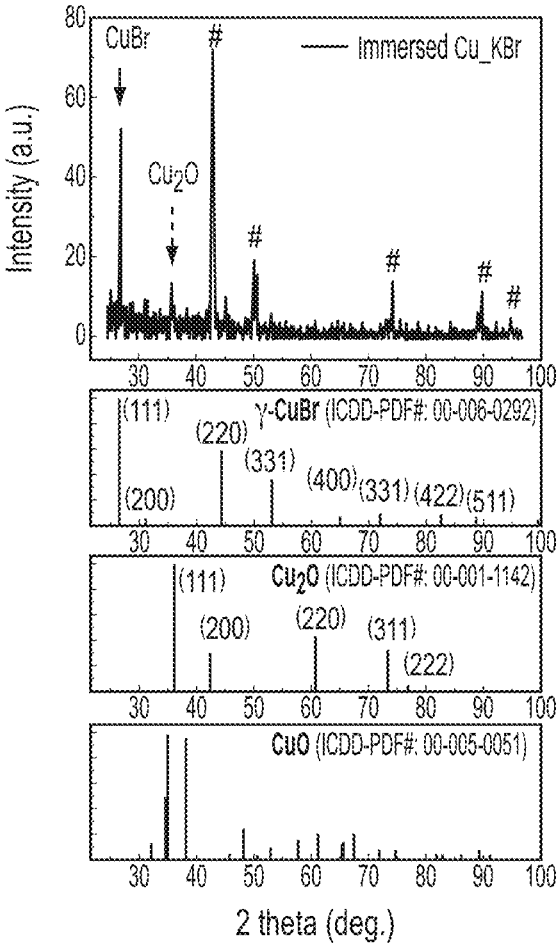
Figure 11D:
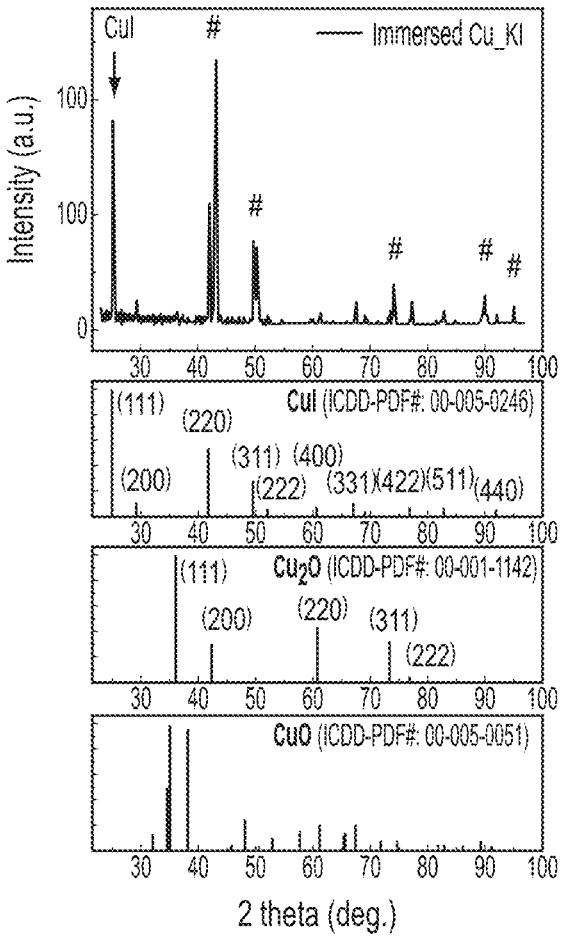

The morphology of the Cu foils was expected to change with changes in crystal structure. Therefore, SEM was used to examine samples subjected to anodic halogenation for 50 s (FIG. 4A-4L). SEM images of samples halogenated for other lengths of time and at different applied potentials are shown in FIGS. 14A-14H, FIGS. 15A-H, FIGS. 16A-16F and FIGS. 21A-21C and SEM images of the control sample are shown in FIG. 10. Cross-sectional images of the samples reveal that a halogenated Cu layer forms on electropolished Cu foils during anodic halogenation in KCl, KBr, or KI for 50 seconds to a thickness of 1.25 μm, 1.11 μm, and 0.61 μm, respectively (FIGS. 4A-4C). Plan-view SEM images of the as-prepared Cu(I) halide are shown in FIGS. 4D-4F. The formation of a surface layer of Cu(I) halide during anodic halogenation causes a volume expansion that results in surface wrinkling to relieve mechanical stress. This wrinkling is observed in Cu_KCl and Cu_KBr samples but not in the Cu_KI sample, where instead, triangle-based pyramids emerge.

The catalysts were subjected to two additional treatments to determine if the morphology of the surface changes further when halogenated Cu foils are immersed in an electrolyte commonly used for $CO_2$ RR experiments: (1) immersion in air-saturated $KHCO_3$, where the pH is basic and (2) electrochemical reduction in $CO_2$-saturated $KHCO_3$, where the pH is nearly neutral (pH 6.8). These two experiments model the environment that catalysts encounter in preparation for the $CO_2$ RR but separate the effect of basic pH from that of reducing potentials at near neutral pH. For the first experiment, all Cu_KX samples (where X is a halogen) were immersed in air-saturated 0.1 M KH $CO_3$ for 10 min. An air-saturated solution of 0.1 M $KHCO_3$ has a measured pH of 9.0, whose basicity is derived from a shift in equilibrium from bicarbonate ion to its weak acid (H2$CO_3$) to produce OH− ions:

$$HCO_3^-(aq)+H_2O(aq)\leftrightarrow H_2CO_3(aq)+OH^-(aq) \quad (1)$$

When purged with $CO_2$ (as in the case for the $CO_2$ RR), the KH $CO_3$ electrolyte becomes more acidic (pH 6.8) because of the formation of carbonic acid:

$$CO_2+H_2O(aq)\leftrightarrow H_2CO_3(aq)\leftrightarrow H^+(aq)+HCO_3^-(aq)\leftrightarrow 2H^+(aq)+CO_3^{2-}(aq) \quad (2)$$

Based on calculated equilibrium diagrams, $Cu_2O$ is more stable than CuCl at pH 9 and open circuit potential. Thus, any morphological changes that may occur when Cu_KX is immersed in KH $CO_3$ will be caused by an oxide-forming reaction that converts the Cu(I) halide into $Cu_2O$:

$$2CuX(s)+OH^-(aq)\leftrightarrow Cu_2O(s)+2X^-(aq)+H^+(aq) \quad (3)$$

In addition, morphological changes should reflect the coordination affinity of copper(I) halides (CuCl<CuBr<CuI) and their solubility product (K SP) in aqueous solution (CuCl>CuBr>CuI).

Figure 4G:
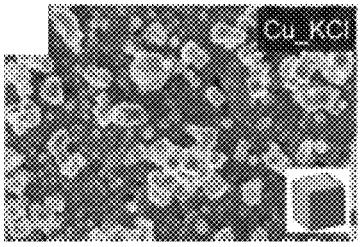
Figure 4H:
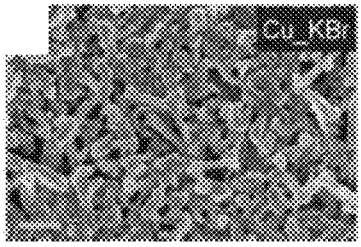
Figure 4I:
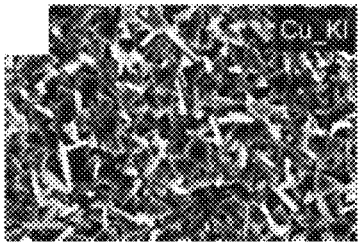
Figure 4J:
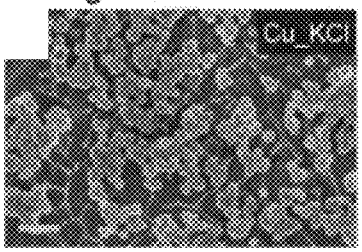

Consequently, when Cu_KCl is immersed in an air-saturated solution of 0.1 M KHCO 3 (pH 9.0) for ten minutes, the relatively unstable CuCl is converted rapidly to $Cu_2O$ with cubic morphology (FIG. 4G). The cubic morphology reflects the relative growth kinetics of different facets, where the direction of slowest growth corresponds to the largest facet. Thus, the emergence of cubic morphology during the conversion of CuCl to $Cu_2O$ suggests that the chloride ions released during this reaction adsorb preferentially on the (100) facet, impeding its growth kinetics. This observation is consistent with simulations that have shown the preferential adsorption of halide ions onto the (100) facet of Cu. When Cu_KBr is subjected to the same treatment, the wrinkled surface of CuBr appears only to shrink slightly from the release of bromide ions into the electrolyte during the oxide-forming reaction [eq. (3)] (FIG. 4H). In contrast, when Cu_KI is subjected to the same treatment, the highly stable and insoluble CuI does not undergo any significant morphological change (FIG. 4I). GI-XRD data further supports the effect of halide ion on the extent to which CuX is converted into $Cu_2O$ in basic $KHCO_3$ (see FIG. 11A-11D). These observations are consistent with the trend in stability and solubility of Cu(I) halides and correspond to different rates of oxide formation via [eq. (3)].

Figure 4K:
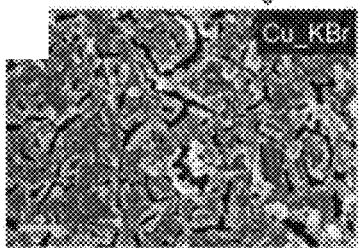
Figure 4L:
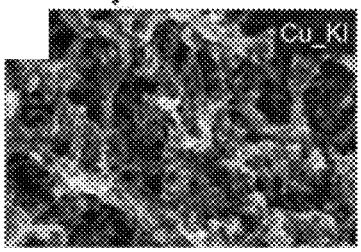
Figure 12A:
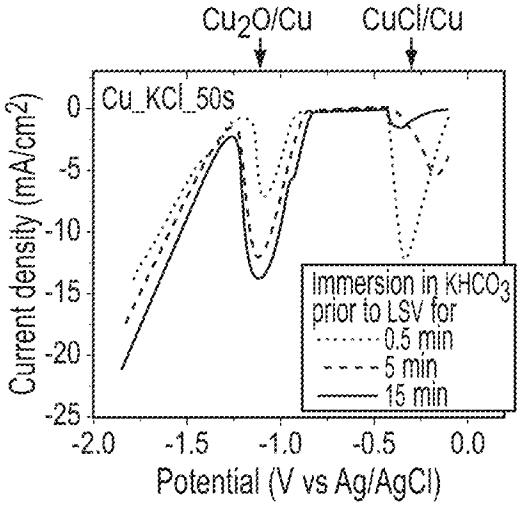
FIG. 12A-12C illustrate linear sweep voltammetry (LSV) data.
Figure 12B:
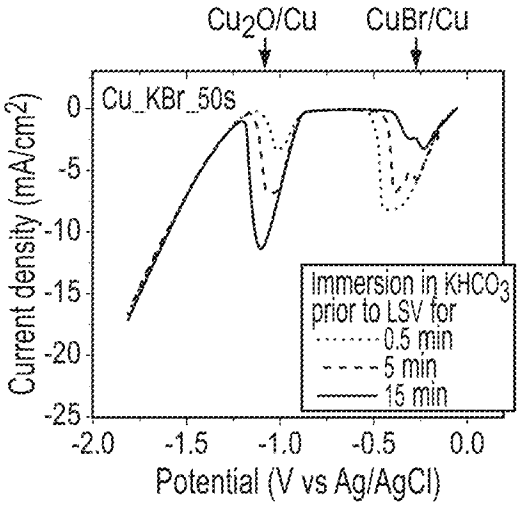
Figure 12C:
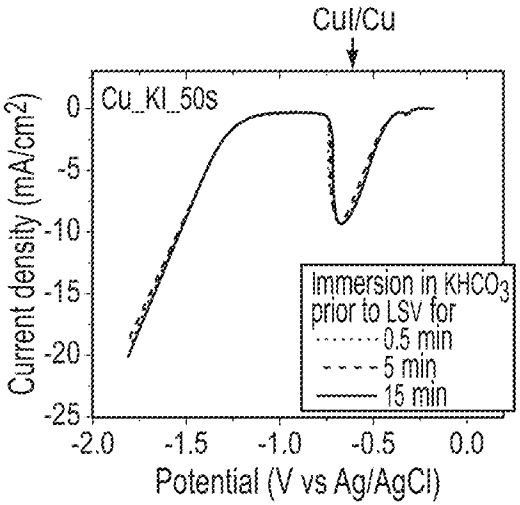
Figure 13:
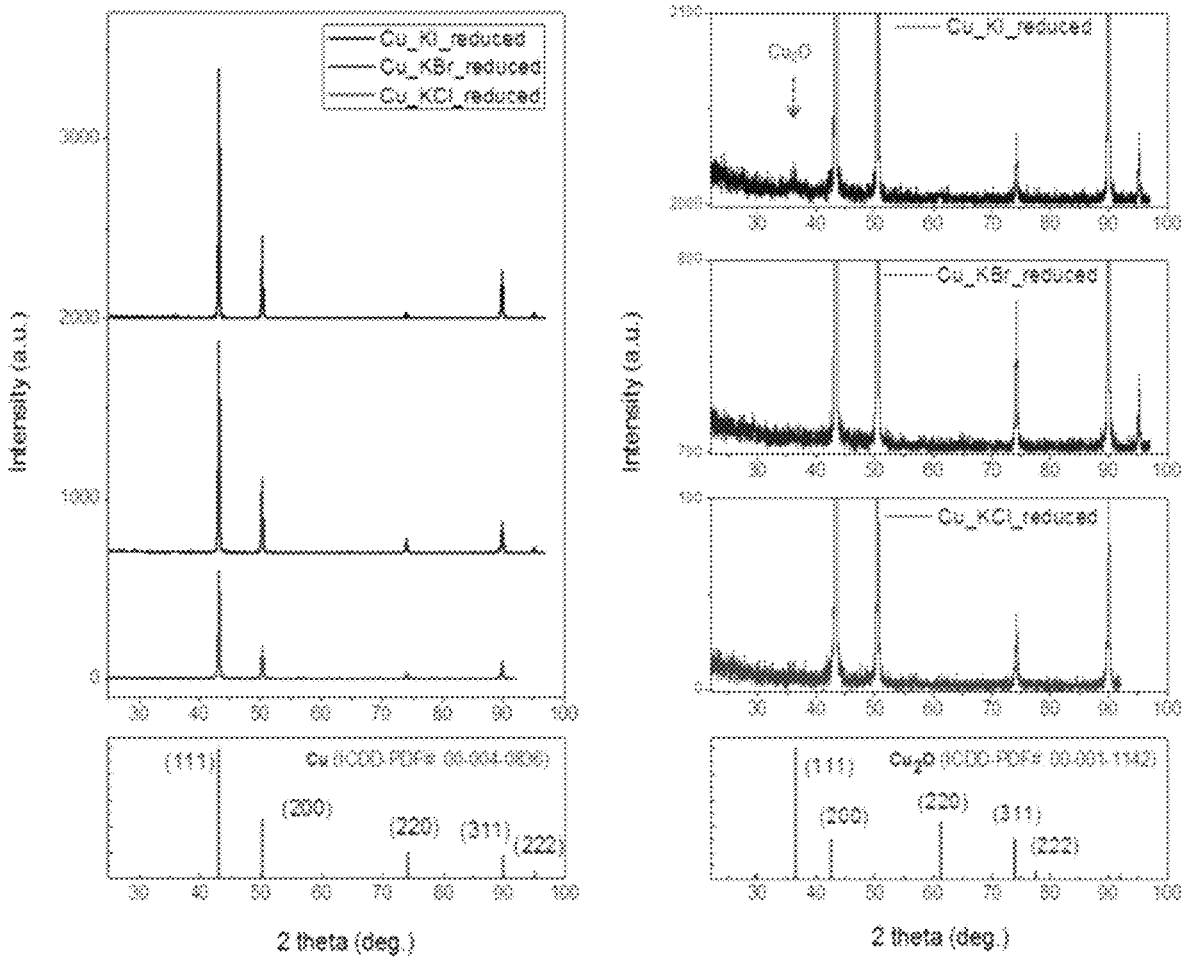
FIG. 13 illustrates GI-XRD data.

For the second experiment, all Cu foils that had been anodically halogenated and converted to oxide in air-saturated $KHCO_3$ were reduced by LSV from the measured OCP to −1.8 V vs. Ag/AgCl at a scan rate of 5 mV/s (FIG. 12A-12C). The resulting GI-XRD data (FIG. 13) is nearly identical to that of the original electropolished Cu, indicating electroreduction by LSV extracts halide ions from the Cu_KX samples. Consequently, reduction of Cu_KCl results in a morphology with smaller but more uniformly sized cubic structures than before (FIG. 4J) and reduction of Cu_KBr results in further shrinkage and consequential formation of cracks (FIG. 4K). The reduction of Cu_KI results in a dramatic change to its morphology (FIG. 4I) and is attributed to the rapid reduction of iodinated Cu:

$$CuI(s)+e^-\rightarrow Cu(s)+I^-(aq) \quad (4)$$

Recall, Cu_KI does not undergo significant oxide-formation in the prior experiment (i.e., immersion in air-saturated KH $CO_3$ electrolyte). Thus, the electrochemical reduction of Cu_KI causes an abrupt release of iodide ions, leading to the dramatic change in morphology that is observed. In contrast, bromide ions from Cu_KBr are released gradually by the oxide-forming reaction before the sample is subjected to electrochemical reduction. Cu_KCl undergoes relatively rapid oxide-formation in KH $CO_3$ electrolyte so that its morphology has already changed prior to being subjected to electrochemical reduction.

Evaluation of Changes in the Chemical Composition of Cu_KX

The elemental compositions (Cu, O, and halogen atoms) of the surface of Cu_KX were determined using EDS for the purpose of relating changes in chemical composition to changes in morphology. Raw EDS data are shown in FIGS. 14A-14D, which can be converted into compositions of molecular species (FIGS. 14E-14H) using the chemical species identified by GI-XRD experiments. It is assumed that the halogenated catalysts consist of only three chemical species (i.e., Cu, $Cu_2O$, and CuX) because other species such as CuO were not observed in the GI-XRD data (see FIGS. 11A-11D and 13). In the case of electropolished Cu, only two chemical species are assumed to exist: Cu and $Cu_2O$.

The initial surface species of Cu_KCl and Cu_KBr are converted into $Cu_2O$ by the oxide-forming reaction [eq. (3)] when the samples are immersed in air-saturated 0.1 M KHCO 3 for 10 min (FIGS. 14F and 14G). For example, EDS data indicates the as-prepared Cu_KCl contains 4.06% of $Cu_2O$ and 67.3% of CuCl. Similarly, as-prepared Cu_KBr contains 4.13% of $Cu_2O$ and 66.6% of CuBr. After immersion, rapid oxide-formation occurs: Cu_KCl contains 46.2% of $Cu_2O$ and 12.0% of CuCl while Cu_KBr contains 63.7% of $Cu_2O$ and 22.4% of CuBr. Unlike Cu_KCl and Cu_KBr samples, Cu_KI showed only slight changes to the composition of the initial surface species due to the high stability of CuI in basic KH CO. The as-prepared sample contained 16.1% of $Cu_2O$ and 83.9% of CuI whereas the immersed sample contained 21.6% of $Cu_2O$ and 78.3% of CuI (FIG. 14H).

Electrochemical reduction of Cu_KX samples by LSV is expected to reduce all Cu(I) species to Cu 0. The converted EDS data reveal (FIGS. 14G and 14H), however, that 0.33% of CuBr and 0.12% of CuI remains on the surface of the respective catalysts with the Cu_KI sample having a relatively higher content of $Cu_2O$ (22.7%) than either the Cu_KCl or Cu_KBr samples (<10%). After electrochemical reduction, the high content of $Cu_2O$ in the Cu_KI is likely due to re-oxidation of the surface upon exposure to air during the time between sample preparation and EDS measurement (<30 min) and indicates that reduced Cu_KI is particularly susceptible to re-oxidation by air. This conclusion is consistent with the fact that Cu_KI undergoes abrupt morphological and chemical changes when electrochemically reduced by LSV, which generates a high density of under-coordinated atoms on the surface of the catalyst. Furthermore, this conclusion is supported elsewhere, where oxide-derived (OD) Cu with a high density of grain boundaries, could be re-oxidized very quickly when exposed to ambient air and moisture.

Figure 14A:
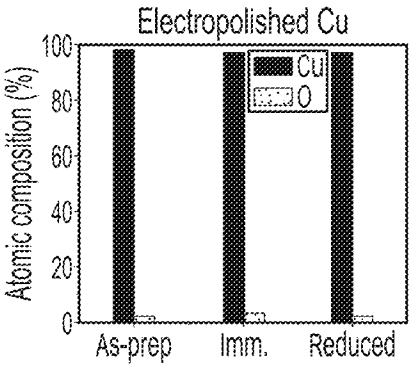
FIG. 14A-14H illustrate energy-dispersive X-ray spectroscopy (EDS).
Figure 14B:
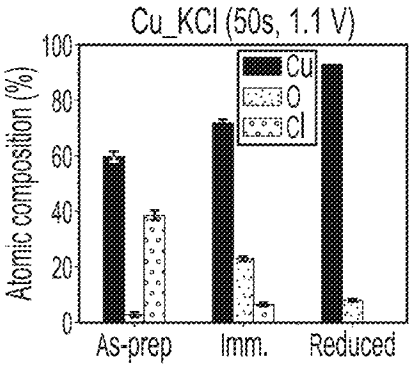
Figure 14C:
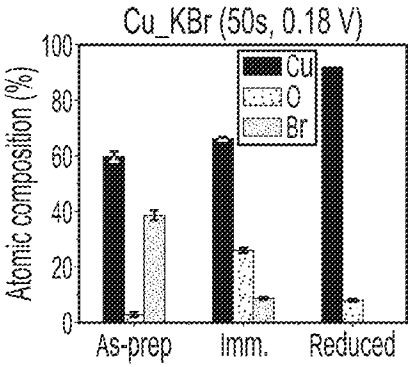
Figure 14D:
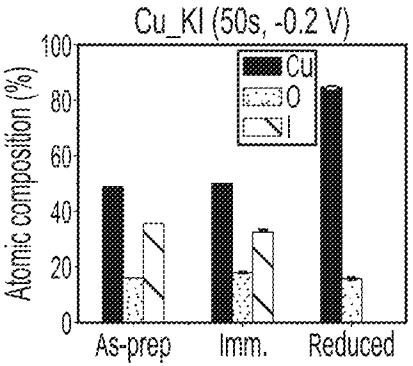
Figure 14E:
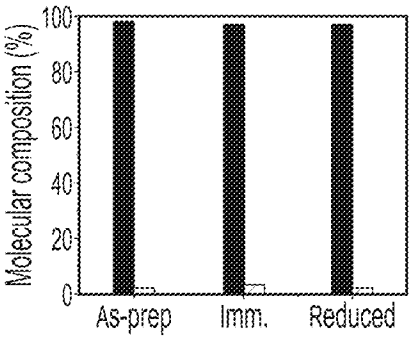
Figure 14F:
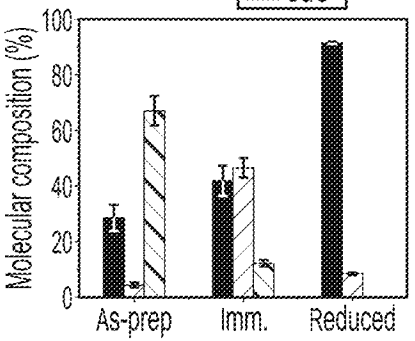
Figure 14G:
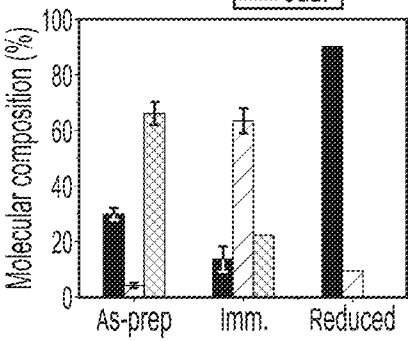
Figure 14H:
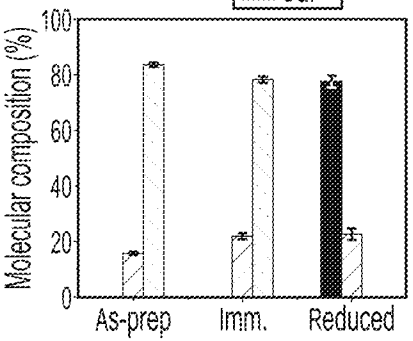
Figure 15A:
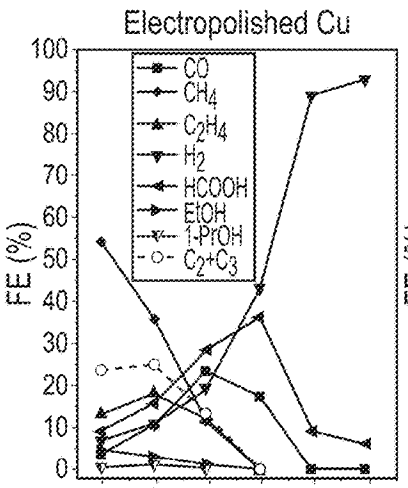
FIG. 15A-15H illustrate performance of catalysts for electrochemical $CO_2$ RR.
Figure 15B:
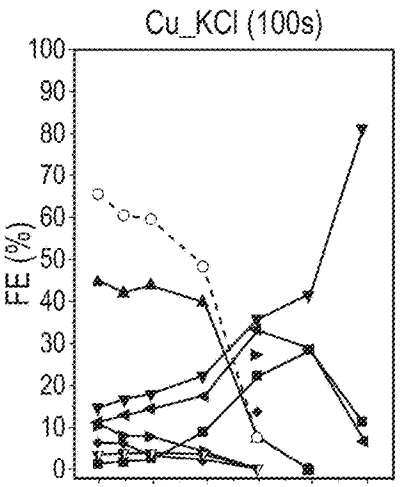
Figure 15C:
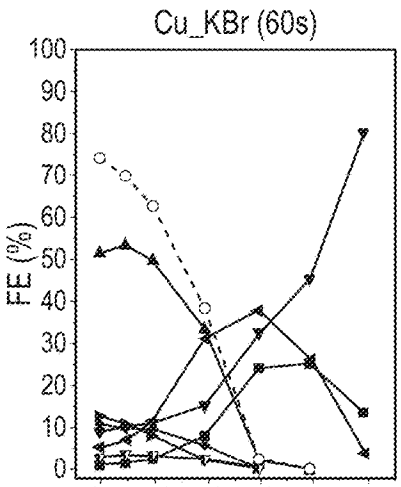
Figure 15D:
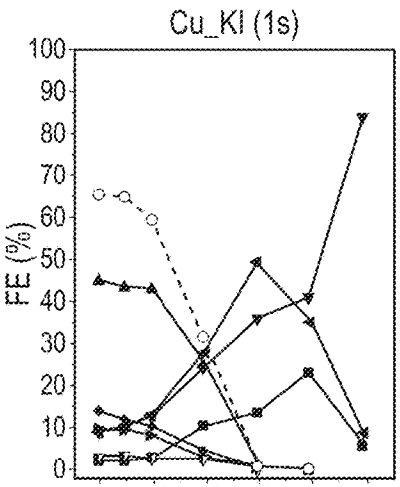
Figure 15E:
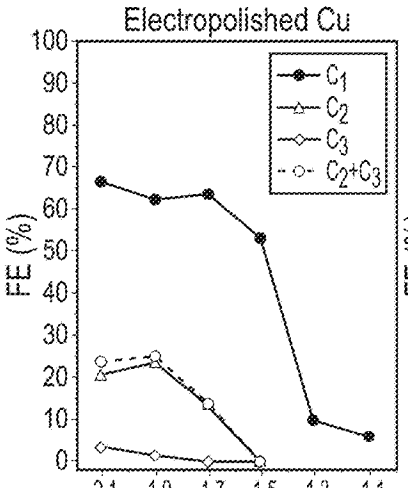
Figure 15F:
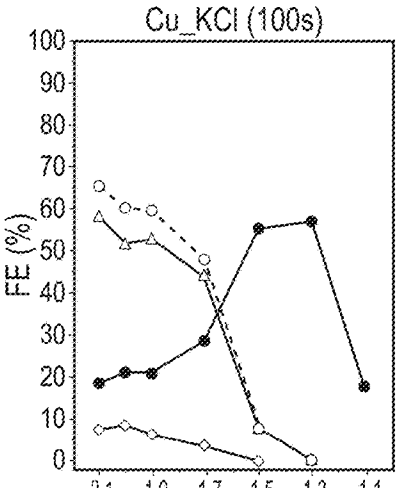
Figure 15G:
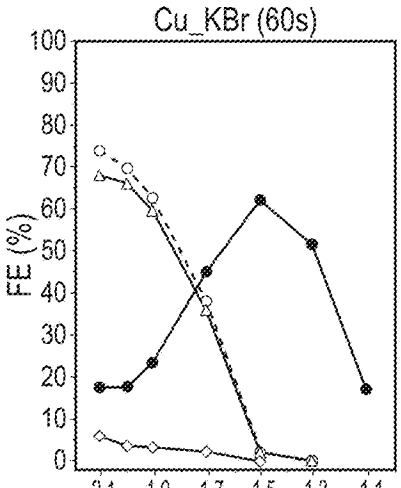
Figure 15H:
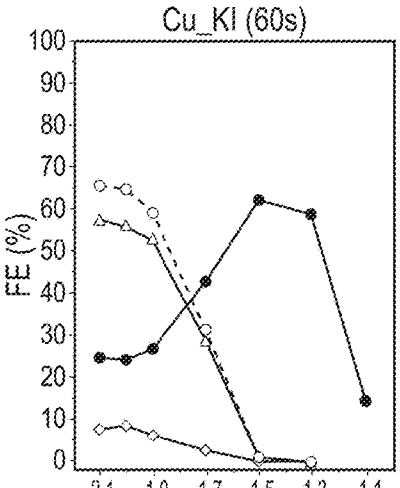

The chemical composition of electropolished Cu does not change significantly when immersed in air-saturated KHCO 3 for 10 min and subsequently electrochemically reduced by LSV as shown in the converted EDS data (FIG. 14E). The percentage of $Cu_2O$ at electropolished Cu, however, does increase slightly from 1.7% to 2.9% upon immersion in air-saturated $KHCO_3$ for 10 min. This slight increase in $Cu_2O$ occurs via the oxidation reaction predicted by the Pourbaix diagram for copper:

$$Cu(s)+OH^-(aq) \leftrightarrow Cu_2O(s)+2e-(aq)+H^+(aq) \quad (5)$$

As such, this reaction is likely to be a weak but important driving force that enables electrocatalysts to maintain C+ and subsurface oxygen despite the highly negative potentials used for electrochemical $CO_2$ RR. The mechanism by which Cu+ species are stable to conditions used for $CO_2$ RR, however, remains indeterminate. Nevertheless, because basic pH favors the oxidation reaction that forms $Cu_2O$ [Eq. (5)] (i.e., hydroxide ions are consumed and protons are released), the rate of this reaction is enhanced during the electrochemical $CO_2$ RR, where protons are consumed and the pH near the electrode increases significantly. Thus, when a catalyst has defect sites that are susceptible to re-oxidation (e.g., oxide-derived Cu or plasma-activated Cu), the oxidation reaction [Eq. (5)] will generate $C^+$ and subsurface oxygen at those defect sites where the local pH is high during the electrochemical $CO_2$ RR.

Evaluating the Performance of Catalysts for Electrochemical $CO_2$ RR

To test the activity and selectivity of the halogenated Cu catalysts, bulk electrolysis of $CO_2$ was performed at a constant potential in $CO_2$-saturated 0.1 M $KHCO_3$ for 40 min. Electrochemical $CO_2$ RR experiments were performed over a potential range from −1.1 V to −2.1 V vs. Ag/AgCl (with iR-compensation these potentials correspond to −1.1 V to −1.78 V vs. Ag/AgCl or −0.50 V to −1.18 V vs. RHE). The resulting potential-dependent FEs from these experiments are shown in FIGS. 15A-15H. The catalysts were prepared via halogenation of a Cu foil for different lengths of time (i.e., 100 s for Cu_KCl, 60 s for Cu_KBr, and 1 s for Cu_KI) to ensure complete coverage of the Cu substrate with Cu(I) halide. The major product obtained on Cu(I)-halide-derived catalysts was $C_2H_4$, with its highest FE (45.1% on Cu_KCl, 49.5% on Cu_Kbr, and 44.5% on Cu_KI) observed at −2.1 V vs. Ag/AgCl (see FIG. 18). For comparison, the major product obtained on electropolished Cu was $CH_4$, with its highest FE (54.0%) at the same potential. Moreover, the Cu(I)-halide-derived catalysts produced CO with FEs in the range of 23-28% at potentials as low as −1.3 V vs. Ag/AgCl whereas electropolished Cu at this potential yielded CO with a FE of only 0.5%. Adsorbed CO (*CO) is an important intermediate required for production of $C_2$ and $C_3$ products via C—C bond coupling. The rate of reaction to produce $C_2H_4$ is second order with respect to the surface concentration of adsorbed CO (*CO). Thus, a high density of active sites on the surface of the catalyst is necessary to produce a high surface concentration of *CO.

Figure 6:
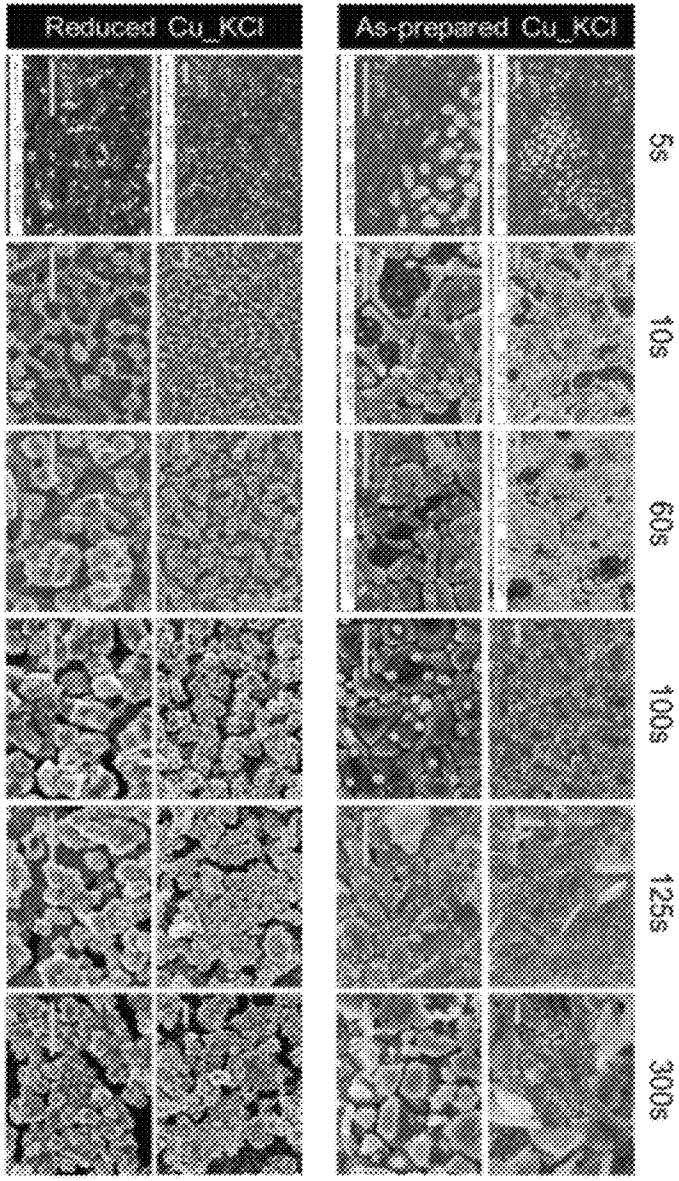
FIG. 6 illustrates plan-view SEM images.
Figure 7:
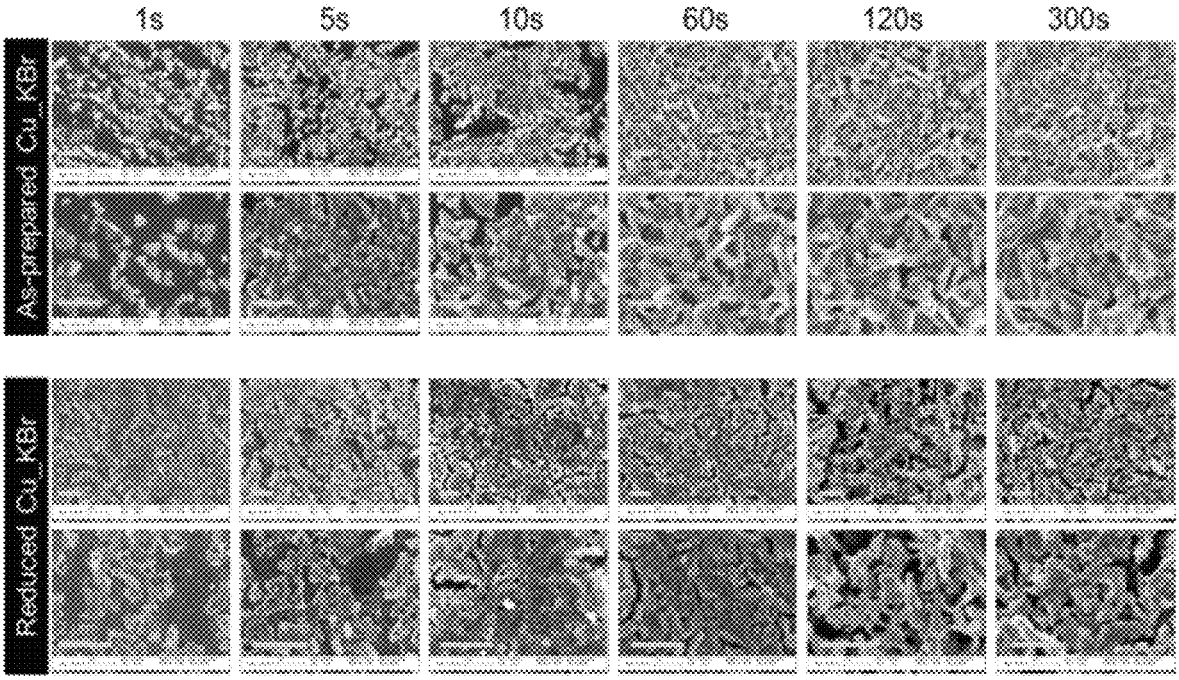
FIG. 7 illustrates plan-view SEM images.
Figure 8:
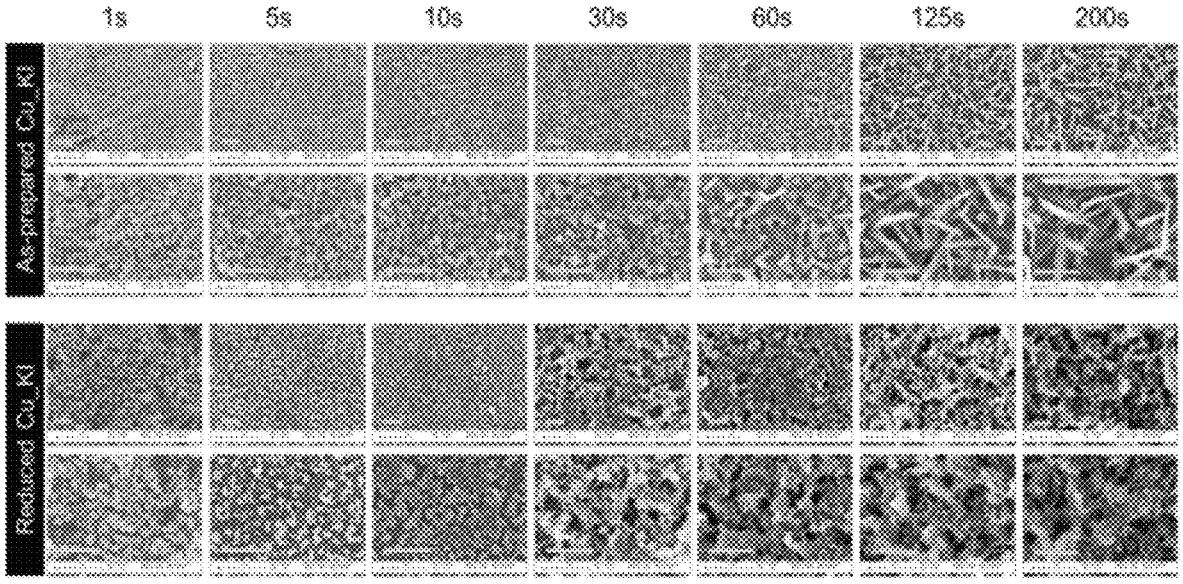
FIG. 8 illustrates plan-view SEM images.
Figure 9:
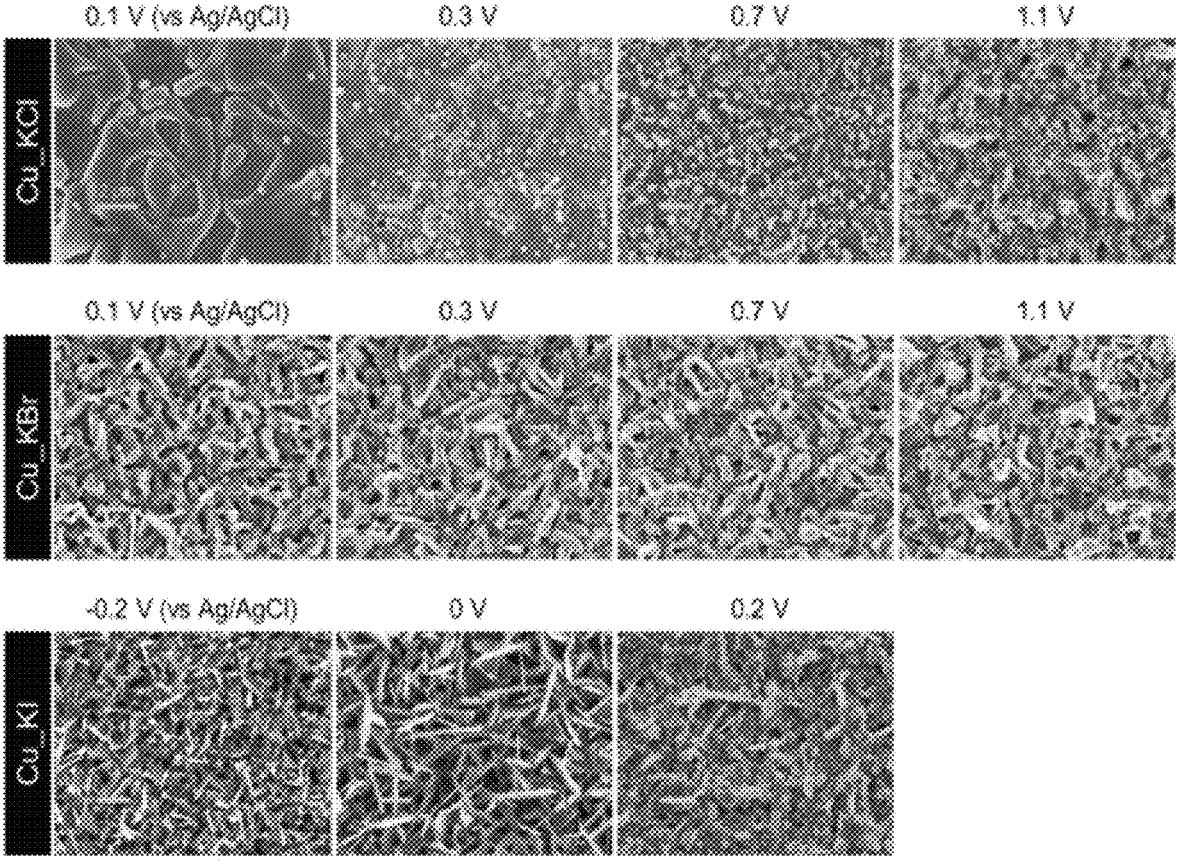
FIG. 9 illustrates plan-view SEM images.

The efficiency ($n_{hal}$) of anodic halogenation is defined as:

The effect of anodic halogenation time on $CO_2$ RR performance also was investigated (FIGS. 16A-16F). All data shown in FIGS. 16A-16F were collected at −2.1 V vs. Ag/AgCl, where the FE for $H_2$ was the lowest amongst all applied potentials studied. FIGS. 6-8 reveal that the underlying electropolished Cu substrate is exposed when anodic halogenation is performed for short periods of time. Thus, the Cu_KX catalysts produced by anodic halogenation for a short reaction time showed relatively high amounts of $CH_4$ and low amounts of $C_2H_4$ and $H_2$, a product distribution expected from electropolished Cu. Thus, to completely cover the underlying Cu substrate by Cu(I) halide, anodic halogenation needs to be applied for at least 60 s for Cu_KCl, 60 s for Cu_KBr and 5 s for Cu_KI. For these reaction times, 3.82 C/cm 2, 0.80 C/cm 2, and 0.028 C/cm 2 of charge per unit area of electrode was used to make CuCl, CuBr, and CuI layers on electropolished Cu, respectively. The amount of charge vs. different amounts of time used for anodic halogenation is shown in FIGS. 17A-17B. A relatively short amount of time of anodic halogenation covers the Cu substrate with CuI because iodide ions have a high ligand affinity for Cu and the resulting CuI is highly stable. In contrast, anodic chlorination or bromination of Cu requires more time to completely cover the Cu surface.

$$n_{hal}=\text{(charge to produce Cu(I) halide)/(total charge flowed)} \quad (6)$$

When Cu is anodically chlorinated, some portion of charge is lost to the dissolution of Cu:

$$Cu(s) \leftrightarrow Cu^{2+} \text{ or } Cu^{+}(aq)+2e^{-} \text{ or } e^{-} \quad (7)$$

This inefficiency was evident by the bluish green color (and some precipitates) of the KCl electrolyte after anodic halogenation. In contrast, the KI electrolyte does not acquire color after anodic halogenation. Thus, setting the halogenation efficiency of Cu_KI [$n_{hal}$ (Cu_KI)] to 1, the order of halogenation efficiency in the different electrolytes is: $n_{hal}$(Cu_KCl)<$n_{hal}$(Cu_KBr)<$n_{hal}$(Cu_KI). Consequently, the large amount of charge (3.82 C/cm$^2$) required to cover the Cu substrate completely with Cu_KCl is due to its low halogenation efficiency.

When the halogenation reaction time is increased up to 300 s, the FE for $H_2$ on all three Cu(I)-halide-derived catalysts increases significantly (i.e., FE for $H_2$ was 17.4% on Cu_KCl, 15.1% on Cu_KBr, and 19.9% on Cu_KI). To minimize the competing HER reaction, an optimal halogenation time was sought for each Cu_KX catalyst. The Cu_KCl catalyst that generated $C_2H_4$ with a FE of 50.2% and $C_{2+}$ products with a FE of 70.7% was prepared using an anodic chlorination time of 60 s. Likewise, the Cu_Kbr catalyst that generated $C_2H_4$ with a FE of 50.9% and $C_{2+}$ products with a FE of 71.5% was prepared using an anodic bromination time of 90 s and the Cu_KI catalyst that generated $C_2H_4$ with a 50.0% and $C_{2+}$ products with a FE of 72.6% was prepared using an anodic iodination time of only 10 s (see FIG. 18).

Roughness Factor, Local pH, and Competing HER

Figure 20A:
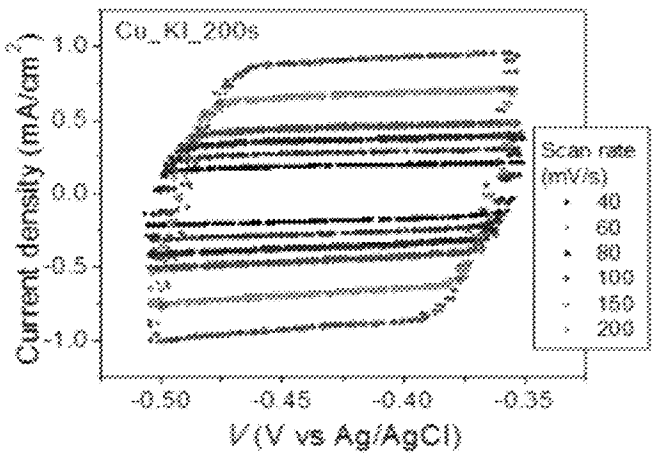
FIG. 20A-20B illustrate double-layer (DL) capacitance measurements.
Figure 20B:
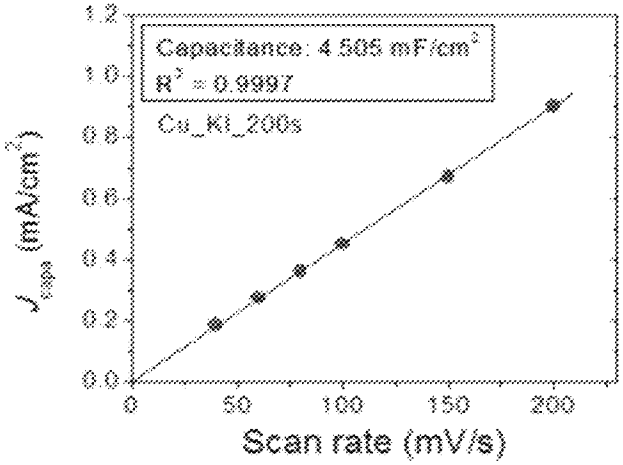
Figure 21C:
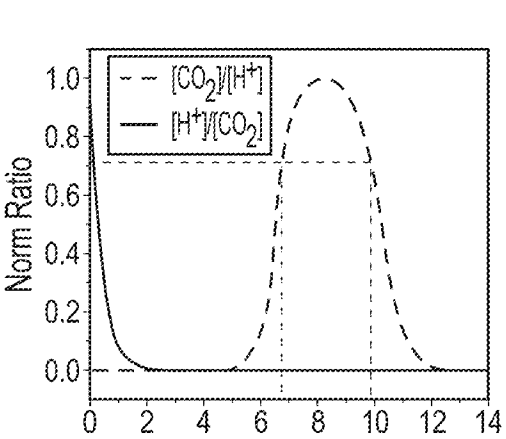
FIG. 21A-21C illustrate a relation between surface roughness of the electrocatalysts and HER.
Figure 21B:
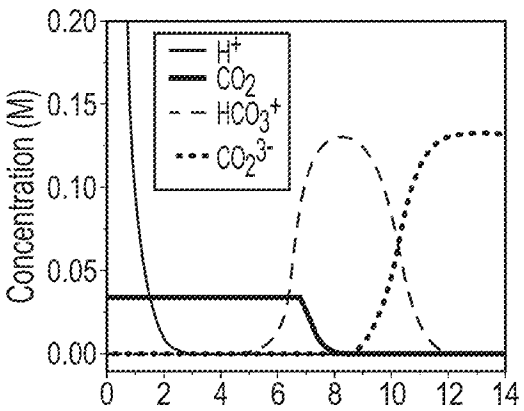
Figure 21A:
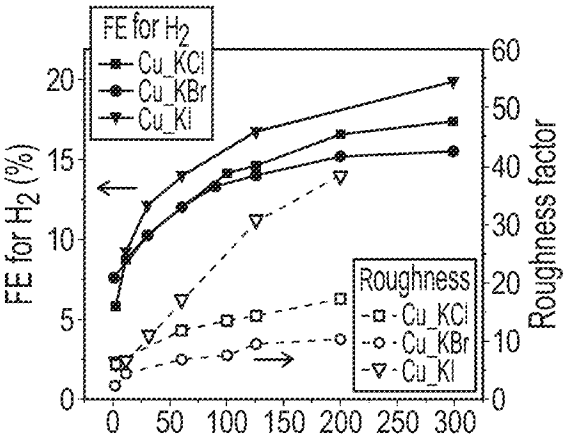
Figure 22A:
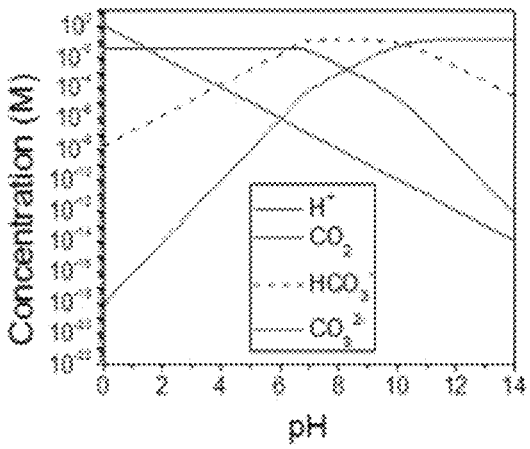
FIG. 22A-22D illustrate calculated concentration of ions in $CO_2$-saturated 0.1 M $KHCO_3$ as a function of pH.
Figure 22B:
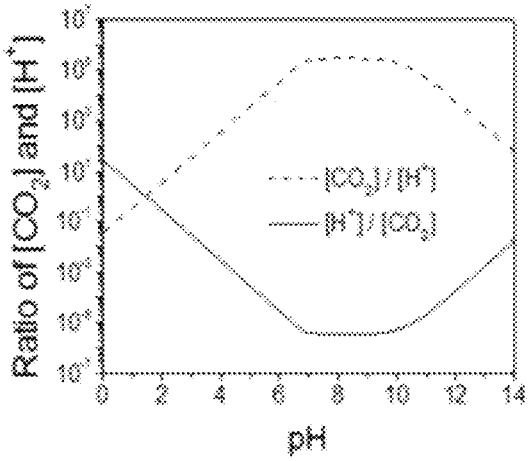
Figure 22C:
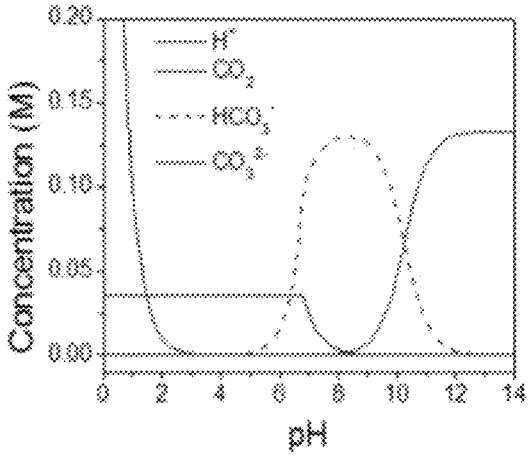
Figure 22D:
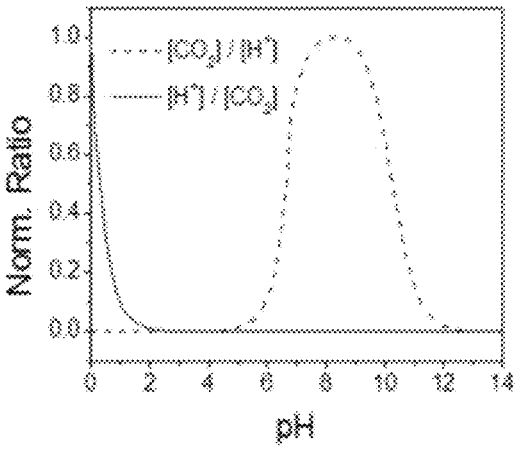

Anodic halogenation generates a high density of active sites, which can be crystal grain boundaries or defect sites such as step atoms or under-coordinated atoms. These active sites in turn increase the production of $C_2$ products from $CO_2$ RR. If halogenation time is too long, however, the competing HER increases because the surface of the catalyst becomes too rough (see FIG. 19). The roughness factor of an electrocatalyst can be determined by the double-layer (DL) capacitance method with the assumption that the surface charge is constant across different kinds of catalysts (see FIG. 20A-20B). FIG. 21A shows the relative roughness of Cu_KX as measured by DL capacitance, which are related as:

roughness factor=DL capacitance of the catalyst/DL capacitance of the electropolished Cu Higher surface roughness promotes more HER. FIG. 21A shows the relationship between the roughness of the catalysts, FE for $H_2$, and halogenation time. This correlation between roughness and HER can be explained by a decrease in the concentration ratio of dissolved $CO_2$ to proton ([$CO_2$]/[H+]) near the surface of the catalyst at high local pH. Although the buffering capacity of the bicarbonate electrolyte minimizes any increase in pH, the high current density observed at catalysts with high roughness rapidly depletes protons in the interfacial region and leads to a high local pH. With high local pH, dissolved $CO_2$ becomes bicarbonate and carbonate ions by the equilibrium reaction shown in equation (2). The concentrations of dissolved $CO_2$, bicarbonate and carbonate ions, and protons in the electrolyte were calculated and are shown in FIG. 21B. The normalized concentration ratio of [$CO_2$]/[H+] (and its inverse) is shown in FIG. 21C, which at pH 6.8 and 9.9 is 0.706. In contrast, the maximum concentration ratio of [$CO_2$]/[H+] occurs at pH 8.3. Above pH 9.9, the concentration ratio of [$_{H2}$]/[$H^+$] decreases rapidly so that HER is favored over electrochemical $CO_2$ RR.

Interfacial Diffusion Layer Thickness and Stirring, Local pH, and Competing HER

Figure 5:
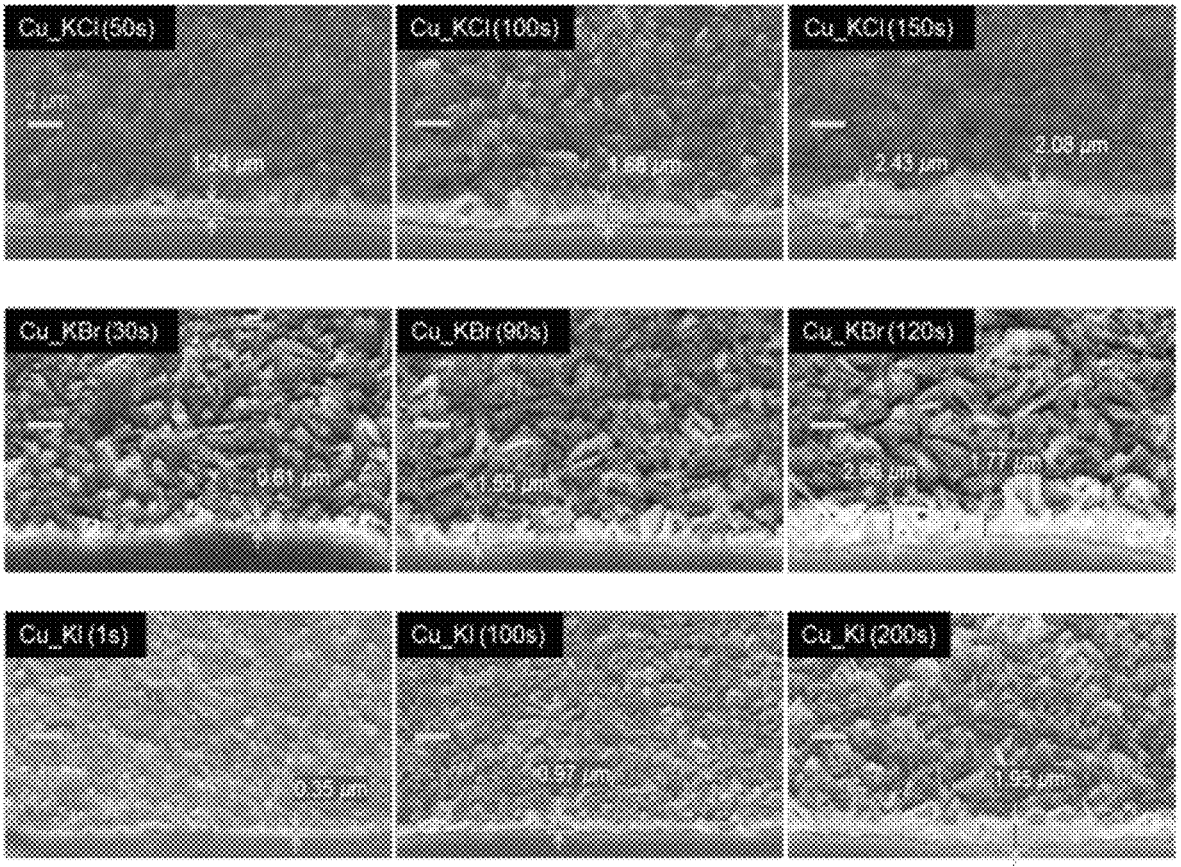
FIG. 5 illustrates cross-sectional SEM images.

Simulations of the electrochemical $CO_2$ RR indicate the local pH is 10.75 when conditions are specified to have a concentration of 0.1 M $KHCO_3$, an interfacial diffusion layer thickness of 0.1 mm, and a current density of 15 mA/cm 22. These simulations also show that the local pH can be reduced to 9.6 when the interfacial diffusion layer thickness is reduced by an order of magnitude to 0.01 mm. Thus, in addition to low roughness, stirring the electrolyte reduces the interfacial diffusion layer thickness, thereby mitigating a rise in local pH and HER. Moreover, stirring facilitates mass transport of chemical reactants from bulk solution to the surface of the electrode. For example, in this work, the FEs for $H_2$, $C_2H_4$, and $C_{2+}$ products were 9.3%, 50.0% and 72.6%, respectively, using Cu foils iodinated for 10 s (see FIG. 5).

High Density of Defect Sites

Figure 23A:
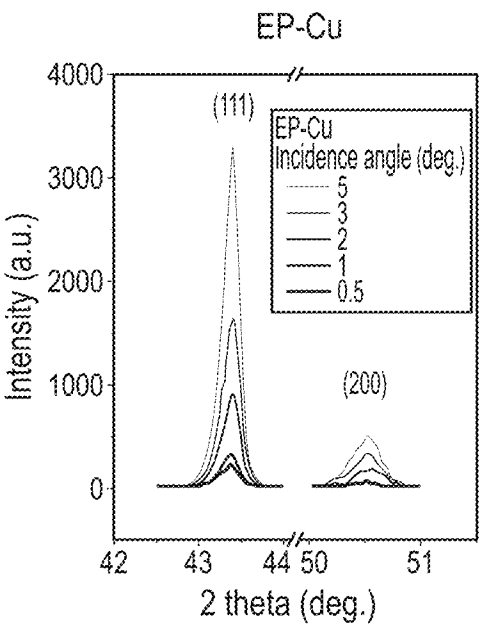
FIG. 23A-23C illustrate GI-XRD data.
Figure 23B:
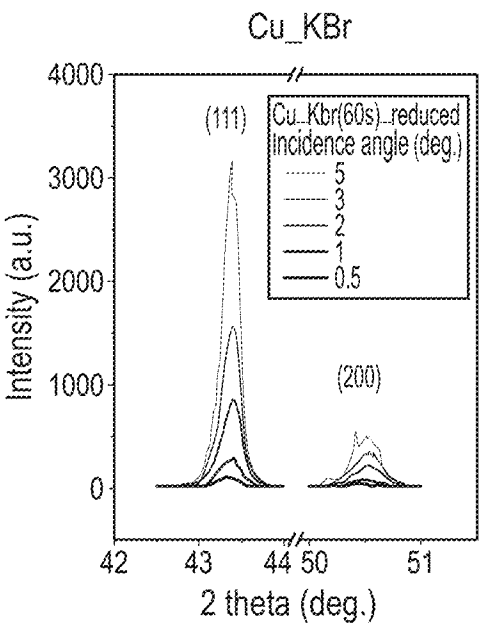
Figure 23C:
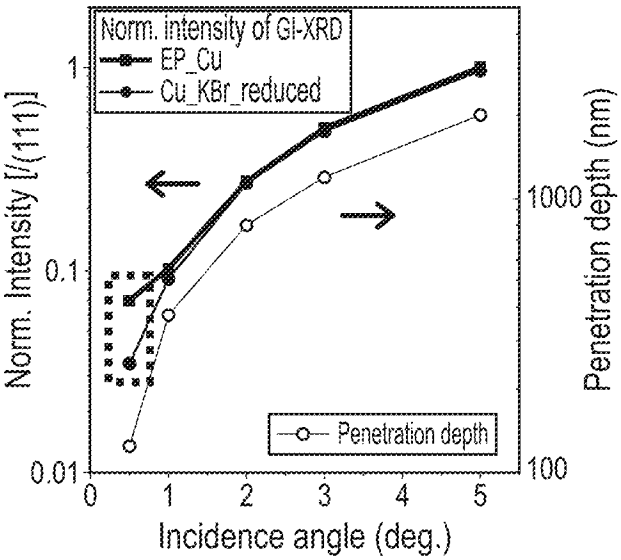
Figure 24A:
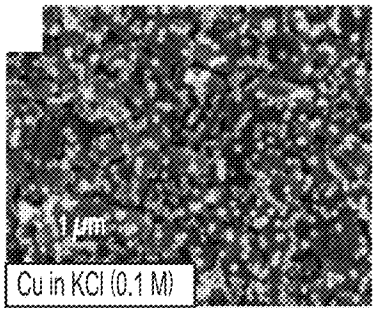
FIG. 24A-24F illustrates an exemplary scheme.
Figure 24A:
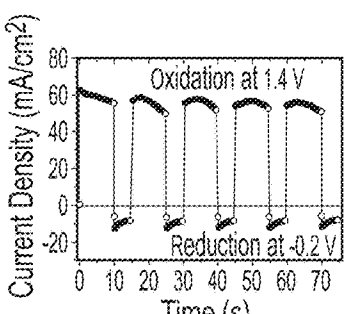
Figure 24C:
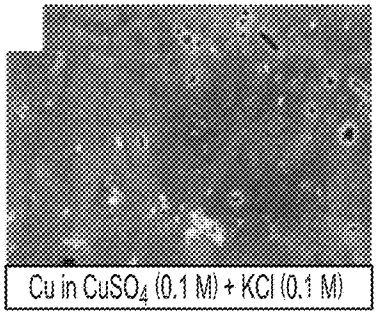
Figure 24C:
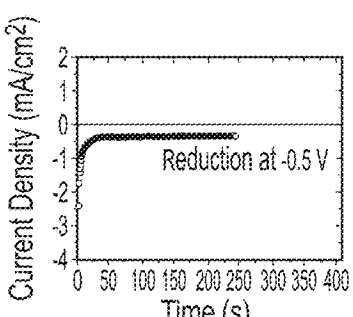
Figure 24E:
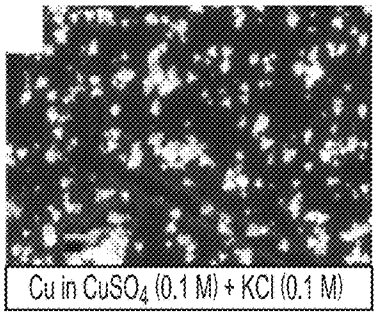
Figure 24E:
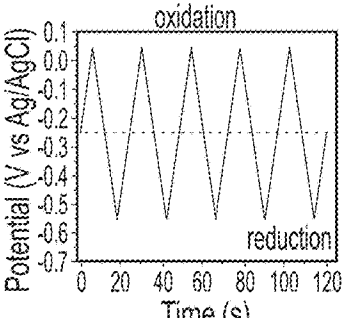
Figure 24B:
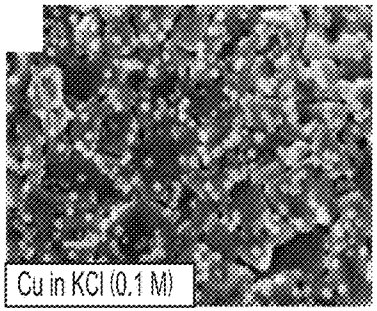
Figure 24B:
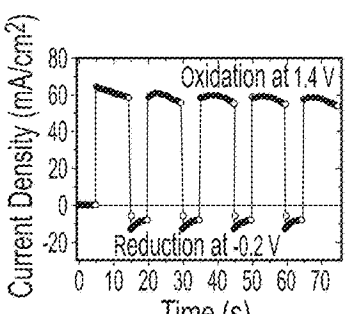
Figure 24D:
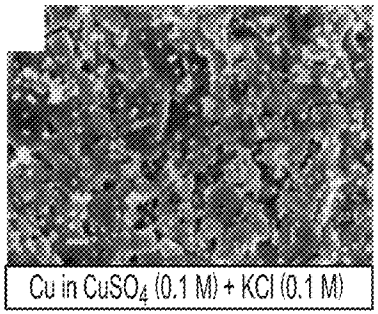
Figure 24D:
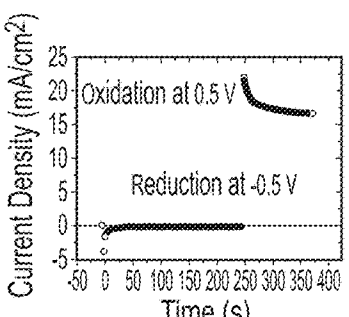
Figure 24F:
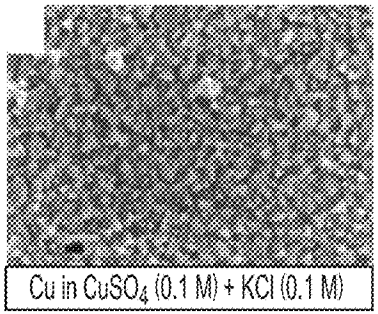
Figure 24F:
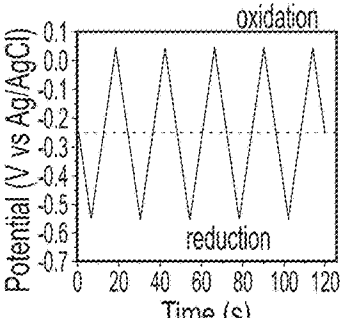

Anodic halogenation of electropolished Cu followed by surface reconstruction from base-induced oxide formation and electroreduction creates a surface with a high density of defect sites. These sites stabilize species such as $Cu^+$ and subsurface oxygen, which are known to promote $C_{2+}$ production during the electrochemical $CO_2$ RR. Evidence of a high density of defect sites on the surface of Cu_KX catalysts is provided by incidence-angle dependent GI-XRD data (FIG. 23A-23C), which shows decreased crystal ordering at the surface of Cu_KBr during surface reconstruction. Furthermore, EDS data reveals the high susceptibility of these surfaces to re-oxidation. The density of defect sites in oxide-derived Cu has recently been determined using positron annihilation spectroscopy (PAS). Based on our results, we conclude that a high density of defect sites is the most important attribute of a Cu catalyst that selectively converts $CO_2$ into $C_{2+}$ products via the electrochemical $CO_2$ RR.

Roughness Factor and Ethane

Interestingly, ethane ($C_2H_6$) is produced when the roughness factor exceeds 30 (FE C2H6=~1.2% in this work). The mechanistic pathway to produce $C_2H_6$ has been proposed to be the reaction between adsorbed ethylene (*$C_2H_4$) and adsorbed hydrogen (*H). 50 Therefore, observation of $C_2H_6$ indicates high surface concentrations of both * $C_2H_4$ and *H, which only can be attributed to a high density of defect sites and high roughness, respectively. Thus, production of $C_2H_6$ indicates that the roughness of the catalyst needs to be lowered to obtain the optimal balance of a high density of defect sites that favors $C_2H_4$ production and low roughness that suppresses HER.

In summary, Cu(I)-halide-derived catalysts were prepared using anodic halogenation. The optimal time and voltage for anodic halogenation was 60-100 s at 1.1 V, 60-90 s at 0.18 V, and 10 s at −0.2 V vs. Ag/AgCl for Cu_KCl, Cu_KBr, and Cu_KI, respectively. Iodide ions react with the Cu surface rapidly at weak oxidative potentials because of the high affinity of I—to form CuI. All Cu(I)X-derived catalysts (where X=Cl, Br, or I) were found to be excellent catalysts for producing $C_{2+}$ products via the electrochemical $CO_2$ RR with FE C2+ of 70.7%, 71.5%, and 72.6% on Cu_KCl, Cu_KBr, and Cu_KI, respectively. By exploiting volume changes that occur during anodic halogenation and subsequent surface reconstruction, we've shown that anodic halogenation is a simple to perform and scalable method for consistently preparing Cu catalysts with a high density of surface defect sites and low roughness. The high density of defect sites promotes production of multi-carbon products and the low roughness suppresses the competing HER. These results, taken together, provide a new approach to preparing catalysts for efficient conversion of $CO_2$ to $C_{2+}$ products that has characteristics desirable for carbon utilization technologies: simple to perform, consistent, regenerative, and scalable.

Preparation of Electrocatalysts

All Cu foils were mechanically polished with 400 grit sandpaper, and rinsed with deionized (DI) water. The Cu foils (2×5 $cm^2$) subsequently were electropolished by chronoamperometry in 85% phosphoric acid at 1.5 V with a Cu counter electrode in a two-electrode configuration. The electropolished Cu foils were rinsed with DI water. After cutting the electropolished Cu foils into 2×0.5 $cm^2$ pieces, the foils were flattened and both the back side and part of the front side were covered with polyimide (PI) tape to define the geometric area of the working electrode. The electrode was wrapped in PTFE tape to prevent detachment of the PI tape. The exposed geometric area was typically 0.35 $cm^2$ KCl (Macron fine chemicals), KBr (Fisher Scientific), and KI (Fisher Scientific) were dissolved in DI water to a concentration of 0.1 M. Anodic chlorination, bromination, and iodination was performed on an electropolished Cu foil immersed in 0.1 M KCl, Kbr, and KI at 1.1 V, 0.18 V, and −0.2 V vs. Ag/AgCl, respectively, in a three-electrode configuration using a potentiostat (Pine Instrument Company, Biopotentiostat, model AFCBP1). The counter electrode was Pt gauze and the reference electrode was Ag/AgCl (saturated KCl) electrode. The open circuit potentials of electropolished Cu in 0.1 M KCl, KBr, and KI was −0.115 V, −0.134 V, and −0.315 V vs. Ag/AgCl, respectively (FIG. 24A-24F).

Characterization of the Electrocatalysts

SEM images were acquired using a LEO 1530 VP ultra-high resolution field emitter SEM at 10 kV. Elemental analysis of samples was obtained using the EDS accessory (Oxford Instruments, Inca X-sight, model 7426) of the SEM. The GI-XRD data were obtained using a Bruker D8 Discovery High resolution X-ray Diffractometer at incidence angle of 2° and wavelength of 1.54 Å. The double-layer capacitance was measured by cyclic voltammetry in the potential range from −0.35 to −0.5 V vs. Ag/AgCl in $CO_2$-saturated 0.1 M KH $CO_3$ after electrochemical $CO_2$ RR.

Electrochemical $CO_2$ Reduction

Electrochemical $CO_2$ RR was carried out in a custom made two compartment cell, separated by a Nafion 117 proton-exchange membrane. The two compartments were filled with 8.2 ml of 0.1 M KH $CO_3$ (Sigma-Aldrich, ≥99.95%) electrolyte. A three-electrode configuration was employed: Cu foil working electrode, Pt gauze counter electrode, and a home-built Ag/AgCl reference electrode. The working and reference electrodes were placed in the cathode compartment and the Pt gauze counter electrode was placed in the anode compartment. Prior to initiating electrochemical $CO_2$ RR, the halogenated Cu foil electrode was immersed in 0.1 M KH $CO_3$ electrolyte and linear sweep voltammetry was performed with a scan rate of 5 mV/s from the open circuit potential to the working potential (usually −0.2 V to −2.1 V vs Ag/AgCl). Subsequently, $CO_2$ RR was performed with fresh electrolyte saturated with $CO_2$. Before and during electrochemical $CO_2$ RR, the cell was purged continuously with $CO_2$ at a flow rate of 20 mL/min as measured with a rotameter (OMEGA FL-3841G FT-032-41-GL-VN). Electrochemical $CO_2$ RR was performed by chronoamperometry for 40 min with a magnetic stirring bar spinning at 1500 rpm. A Thermolyne Nuova stir plate (model No. SP18425) was used to stir a 1-cm-long magnetic bar in the electrolyte. The stirring speed was calibrated in comparison with the Fisher Scientific hot plate/stirrer (Cat. No. 11-100-49SH). It is worth noting that all experimental results on electrochemical $CO_2$ RR were obtained while stirring the electrolyte with a magnetic stirrer at 1500 rpm. After electrochemical $CO_2$ RR, the solution resistance (R) was measured with a potentiostatic electrochemical impedance spectrometer (Solartron, 1255 HF Frequency Response Analyzer) at 10 kHz. All electrochemical data was collected vs. Ag/AgCl reference. The iR-compensated potentials relative to the reversible hydrogen electrode (RHE) use the following equations:

$$V\ comp\ (Ag/AgCl)=V\ appl\ (Ag/AgCl)+iR$$

$$V\ comp\ (RHE)=V\ comp\ (Ag/AgCl)+0.197+0.059*pH$$

Liquid phase products in the catholyte were collected for quantification using nuclear magnetic resonance (NMR).

Product Analysis

The reduction compartment of the gas-tight reactor was connected to the inlet of the sample loop of a gas chromatograph (GC, Buck Scientific, Model 910). GC measurements were performed on sample injections taken after 10 min and 38 min of the $CO_2$ RR to determine the concentration of gaseous products present: CO, $CH_4$, $C_2H_4$, $H_2$. The GC was equipped with a methanizer and a flame ionization detector (FID) to detect CO and hydrocarbons and a thermal conductivity detector (TCD) to detect $H_2$. Nitrogen was used as the carrier gas. Liquid products were quantified using 1D 1H NMR (400 MHz, Bruker high field NMR spectrometers). Each sample of catholyte (700 μL) was mixed with 35 μL of a D2O solution containing internal standards: 50 mM phenol and 10 mM dimethyl sulfoxide (DMSO). The water peak was suppressed by a WET procedure (Bruker). The acquired NMR data were processed with Topspin 4.0.5 software. The peak area of the liquid product (formate) at higher chemical shift with respect to the suppressed water peak (chemical shift=4.7 ppm) was normalized to the peak area of phenol (chemical shift=7.2 ppm). The peak areas of the liquid products (acetate, ethanol, propanol, acetaldehyde, propionaldehyde, glycolaldehyde, and allyl alcohol) at lower chemical shift with respect to the suppressed water peak were normalized to the peak area of DMSO (chemical shift=2.6 ppm).

It would be appreciated by those skilled in the art that various changes and modifications can be made to the illustrated embodiments without departing from the spirit of the present invention. All such modifications and changes are intended to be within the scope of the present invention except as limited by the scope of the appended claims.

What is claimed is:

1. An electrochemical method comprising:

performing anodic halogenation of Cu foils; wherein the anodic halogenation comprises 60-100 s at 1.1 V (vs. Ag/AgCl) for KCl, 60-90 s at 0.18 V (vs. Ag/AgCl) for KBr, or 1-10 s at −0.2 V (vs. Ag/AgCl) for KI;

performing subsequent oxide-formation in a $KHCO_3$ electrolyte; and performing an electroreduction in neutral $KHCO_3$ to generate a copper catalyst comprising cubic structures of Cu and a surface roughness of less than 30; the catalyst capable to provide a faradaic efficiency ≥50% for $C_2H_4$ generation.

2. The electrochemical method of claim 1 wherein the electroreduction in neutral $KHCO_3$ is by linear sweep voltammetry (LSV).

3. The electrochemical method of claim 1 wherein performing anodic halogenation of Cu foils comprises applying an oxidative potential to electropolished Cu foils immersed in an electrolyte containing halide ions.

4. The electrochemical method of claim 1, further comprising:

prior to performing the anodic halogenation of the Cu foils;

mechanically polishing the Cu foils;

rinsing the polished the Cu foils;

electropolishing the Cu foils by chronoamperometry in 85% phosphoric acid at 1.5 V with a Cu counter electrode in a two-electrode configuration;

rinsing the electropolished Cu foils;

cutting the electropolished Cu foils into $2\times0.5$ $cm^2$ pieces;

flattening the electropolished Cu foils;

covering a back side and part of a front side of the flattened electropolished Cu foils with polyimide (PI) tape to define a geometric area of a working electrode; and wrapping the working electrode in PTFE tape to prevent detachment of the PI tape, exposing an area of 0.35 $cm^2$.

5. The electrochemical method of claim 4, further comprising:

dissolving KCl, KBr, and KI in de-ionized (DI) water to a concentration of 0.1 M; and performing the anodic halogenation on an electropolished Cu foil immersed in 0.1 M KCl, KBr, and KI, respectively, in a three-electrode configuration using a potentiostat.

6. The electrochemical method of claim 5 wherein a counter electrode is Pt gauze.

7. The electrochemical method of claim 6 wherein a reference electrode was Ag/AgCl (saturated KCl) electrode.

8. The electrochemical method of claim 7 wherein open circuit potentials of electropolished Cu in 0.1 M KCl, KBr, and KI are −0.115 V, −0.134 V, and −0.315 V vs. Ag/AgCl.

* * * * *